US011135526B1

(12) United States Patent
Fields

(10) Patent No.: US 11,135,526 B1
(45) Date of Patent: Oct. 5, 2021

(54) TOY OR ITEM STORAGE, DISPLAY AND PLAY SYSTEM

(71) Applicant: Robin J. Fields, Delavan, WI (US)

(72) Inventor: Robin J. Fields, Delavan, WI (US)

( * ) Notice: Subject to any disclaimer, the term of this patent is extended or adjusted under 35 U.S.C. 154(b) by 0 days.

(21) Appl. No.: 15/609,892

(22) Filed: May 31, 2017

Related U.S. Application Data

(60) Provisional application No. 62/344,173, filed on Jun. 1, 2016.

(51) Int. Cl.

| | |
|---|---|
| ***A63H 33/42*** | (2006.01) |
| ***A63H 3/36*** | (2006.01) |
| ***A63H 3/50*** | (2006.01) |
| ***A47F 5/08*** | (2006.01) |

(52) U.S. Cl.
CPC ..... *A63H 33/42* (2013.01); *A47F 5/0815* (2013.01); *A47F 5/0869* (2013.01); *A47F 5/0884* (2013.01); *A63H 3/36* (2013.01); *A63H 3/50* (2013.01)

(58) Field of Classification Search
CPC .... A45C 3/00; A45C 3/06; A45C 9/00; A45C 11/16; A47F 7/02; A47F 5/0815; A47F 5/0869; A47F 5/0884; A63H 33/42; A63H 3/50; A63H 3/36
USPC ..... 446/73, 75, 147, 149, 227, 901
See application file for complete search history.

(56) References Cited

U.S. PATENT DOCUMENTS

| | | | | |
|---|---|---|---|---|
| 1,479,252 A * | 1/1924 | Richards | D05B 91/12 | 223/109 R |
| 1,651,738 A * | 12/1927 | Stein | A63H 3/02 | 446/297 |
| 1,768,334 A * | 6/1930 | Stein et al. | A63H 3/52 | 446/297 |
| 1,801,058 A * | 4/1931 | Sutcliffe | A47F 5/02 | 211/163 |
| D98,062 S * | 1/1936 | Gaba | D21/595 | |
| 2,071,926 A * | 2/1937 | Geerlings | B32B 27/00 | 428/124 |
| 2,078,022 A * | 4/1937 | Roemer | A63F 9/088 | 446/227 |
| 2,302,349 A * | 11/1942 | Renshaw | A63H 3/14 | 446/100 |

(Continued)

OTHER PUBLICATIONS

"Doll House Fold N'Store", http://www.toytainer.com/products/doll-house-fold-n-store/, Internet printout dated Dec. 10, 2015, 2 pages.

(Continued)

*Primary Examiner* — Joseph B Baldori
(74) *Attorney, Agent, or Firm* — Boardman & Clark LLP

(57) ABSTRACT

An item storage, display, and play system is provided comprising a vertically hanging, interactive graphic artwork with item retention features. The vertically hanging, interactive graphic artwork is a multi-dimensional artwork scaled to correspond with a size of one or more items and forms a storage and display area which also functions as a play area for items. The items are integrated into one or more scenes on the vertically hanging, interactive graphic artwork. A series of strategically placed item retention features are provided on the vertically hanging, interactive graphic artwork. A device for hanging the vertically hanging, interactive graphic artwork is also provided.

11 Claims, 13 Drawing Sheets

(56) References Cited

U.S. PATENT DOCUMENTS 2,432,318 A * 12/1947 Leech ..... A63H 33/00 446/151
2,479,203 A 8/1949 Brown
2,628,452 A * 2/1953 Gladstein ..... A63H 3/52 224/242
3,099,443 A 7/1963 Koch
3,120,721 A 2/1964 Bukatman et al.
3,274,706 A * 9/1966 Friend ..... B42F 5/00 434/295
3,295,150 A 1/1967 Shapiro et al.
3,316,669 A * 5/1967 Nachbar ..... A63H 33/38 40/620
3,715,816 A * 2/1973 White ..... G09B 1/06 434/429
3,718,260 A * 2/1973 Sharp ..... A47F 7/02 206/495
3,789,546 A * 2/1974 Morrison ..... A47G 9/1045 446/227
3,955,307 A * 5/1976 Payton ..... A63H 3/52 446/92
4,030,235 A * 6/1977 Terzian ..... A63H 3/52 446/296
4,152,865 A * 5/1979 Ikeda ..... A63H 37/00 40/119
4,165,579 A 8/1979 Chase
4,241,527 A 12/1980 Becker
4,295,432 A 10/1981 Hulke
4,316,345 A 2/1982 Rivette et al.
4,372,077 A * 2/1983 Balbuena ..... A63H 3/005 434/178
4,401,219 A * 8/1983 Mink ..... A45C 7/0095 206/466
4,435,915 A * 3/1984 Zaruba ..... A61F 11/002 446/75
4,543,278 A * 9/1985 Ackerman ..... A63H 33/00 248/205.2
4,654,991 A * 4/1987 Jones ..... A63H 33/40 211/118
4,661,072 A * 4/1987 White ..... A63H 33/00 434/260
4,664,266 A 5/1987 Fausett et al.
4,710,979 A * 12/1987 Bull ..... A41B 13/10 2/48
4,738,547 A * 4/1988 Brown ..... A45C 7/0095 383/119
4,749,088 A * 6/1988 Workman ..... A47F 5/0892 211/113
4,749,604 A * 6/1988 Foster ..... A45C 11/16 248/205.2
4,821,883 A * 4/1989 Miller ..... A45C 7/0095 206/225
4,826,059 A * 5/1989 Bosch ..... A45C 11/24 206/350
4,859,084 A * 8/1989 Kaumeyer ..... A45C 3/00 383/39
4,865,097 A * 9/1989 Allen ..... B65D 65/02 150/154
4,889,512 A * 12/1989 Burnett ..... A63H 3/005 446/72
4,911,670 A * 3/1990 McNicholas ..... A63H 3/52 434/429
4,950,194 A * 8/1990 Gullace ..... A63H 3/003 428/17
4,954,114 A * 9/1990 Kawashima ..... A63H 3/00 446/268
4,960,204 A * 10/1990 Young ..... A45C 3/00 190/109
4,966,793 A 10/1990 Covell
4,968,279 A * 11/1990 Smith ..... A63H 33/006 446/227
5,025,918 A * 6/1991 Bergeron ..... A45C 9/00 206/495
5,071,000 A * 12/1991 Stewart ..... A45C 11/16 206/45.24
5,118,318 A * 6/1992 Lorizio ..... A47G 9/0253 428/100
5,121,833 A * 6/1992 Lindsay ..... A45C 7/0095 206/18
5,136,726 A * 8/1992 Kellin ..... A41D 27/08 2/115
5,141,113 A * 8/1992 Elliott ..... A45C 11/16 206/495
5,178,573 A * 1/1993 Smith ..... A63H 3/08 428/16
5,242,048 A * 9/1993 Ellingsworth ..... A47F 7/02 206/495
5,249,683 A 10/1993 Baucom
5,332,093 A * 7/1994 Littlepage ..... A45C 7/0095 190/102
5,333,727 A * 8/1994 Hoppe ..... A47F 7/02 206/486
5,344,356 A * 9/1994 Pizzelli ..... A63H 3/36 428/100
5,363,953 A * 11/1994 Carter ..... A45C 11/16 206/495
5,370,460 A 12/1994 Nelson
5,387,107 A * 2/1995 Gunter ..... G09B 1/02 434/178
5,398,820 A 3/1995 Kiss
5,433,643 A * 7/1995 Pratt ..... A63H 3/003 446/268
5,439,538 A 8/1995 Perry
D367,985 S * 3/1996 Hale ..... D6/328
5,525,088 A * 6/1996 Mayne ..... A63F 3/00895 206/457
5,533,902 A * 7/1996 Miller ..... G09B 1/06 273/273
5,540,609 A 7/1996 Hoag
5,548,913 A * 8/1996 Randolph ..... G09F 11/00 116/321
5,626,503 A * 5/1997 Heftel ..... A63H 3/003 132/275
5,638,561 A * 6/1997 Sperry ..... A41B 13/06 446/72
5,655,589 A 8/1997 Vartanian
5,671,849 A * 9/1997 Bacon ..... A47F 7/02 206/6.1
5,695,380 A * 12/1997 Morrison ..... A63H 3/36 446/268
5,713,470 A 2/1998 Presta
5,713,781 A * 2/1998 Castanis ..... A63H 3/005 446/369
5,733,165 A * 3/1998 Kelley ..... A63H 3/52 446/478
5,733,166 A * 3/1998 Hoag ..... A63H 3/00 40/735
5,734,991 A * 4/1998 Schmid ..... A41D 27/08 2/1
5,758,438 A * 6/1998 Crowell ..... G09F 1/08 283/117
5,772,490 A 6/1998 Leach
D398,465 S * 9/1998 Wieder ..... D6/513
5,799,791 A * 9/1998 Harley ..... A47G 1/12 190/102
5,813,545 A * 9/1998 Greenberg ..... A47F 5/04 211/13.1
5,813,866 A 9/1998 Maeda
5,827,103 A * 10/1998 Carter ..... A63H 33/38 446/71
5,836,588 A * 11/1998 Gerson ..... A63B 63/00 273/348.4
5,845,780 A * 12/1998 Allen ..... A45C 3/00 206/579
5,878,672 A * 3/1999 Ostermann ..... B60N 3/004 108/25
5,887,369 A 3/1999 Danielczak
5,888,595 A 3/1999 Krattiger
5,897,416 A 4/1999 Barrows

(56) References Cited

U.S. PATENT DOCUMENTS 5,897,421 A * 4/1999 Rink ..... G09B 1/06 434/160
6,010,387 A * 1/2000 Nemec ..... A63H 3/10 428/100
6,030,121 A * 2/2000 Strzyinski ..... A45C 7/0095 383/119
6,030,274 A * 2/2000 Kaplan ..... A63H 3/003 206/457
D423,062 S * 4/2000 Hickey ..... D21/511
6,059,122 A * 5/2000 Cartmell ..... A47F 5/0807 211/113
6,089,517 A * 7/2000 Johnstone ..... A63H 3/50 248/205.5
6,113,454 A * 9/2000 Mitchell ..... A63H 33/00 446/227
6,146,238 A 11/2000 Daiber
6,183,335 B1 * 2/2001 Petersen ..... A63H 33/00 446/227
6,233,763 B1 * 5/2001 Spaan ..... A47G 9/0207 446/72
6,244,431 B1 * 6/2001 VanFleet ..... A45C 11/04 206/459.5
6,280,283 B1 * 8/2001 Sisler ..... A63H 3/365 446/100
6,332,824 B2 12/2001 Tell et al.
6,352,321 B1 3/2002 Munoz
D457,763 S * 5/2002 Borys ..... D6/513
6,428,382 B1 * 8/2002 Randolph ..... G09F 11/00 116/321
D476,184 S * 6/2003 Hall ..... D6/601
6,663,282 B2 12/2003 Jeffries
6,663,459 B2 12/2003 Ostolaza
6,672,929 B2 * 1/2004 Leleu ..... A63H 3/14 446/147
6,684,422 B2 2/2004 Lefevre et al.
6,732,659 B2 5/2004 Poon
6,749,001 B2 6/2004 Peppett
6,749,064 B1 6/2004 Alrey
6,845,585 B2 1/2005 Callander et al.
6,945,841 B2 * 9/2005 Becker ..... A63H 3/365 446/100
7,018,267 B2 3/2006 Delaney et al.
7,175,497 B2 2/2007 Herzog
7,211,305 B2 * 5/2007 Steiger ..... A41G 1/001 283/100
7,217,132 B2 5/2007 Knepper
D549,502 S * 8/2007 DeLatte ..... D6/514
7,306,096 B2 * 12/2007 d'Auriac ..... B65D 73/0014 206/301
7,438,194 B2 10/2008 Wang
7,465,211 B2 12/2008 Lai
7,490,726 B2 * 2/2009 Virvo ..... A47F 7/00 206/485
7,508,393 B2 3/2009 Gordon et al.
7,730,564 B2 * 6/2010 Moore ..... A47G 9/1045 446/72
7,749,041 B2 * 7/2010 Leleu ..... A63J 19/00 446/147
7,810,655 B2 10/2010 Wang
7,845,508 B2 12/2010 Rothschild et al.
7,892,064 B2 2/2011 Carruth
8,052,534 B2 * 11/2011 Crouch ..... A63F 1/04 463/43
8,191,713 B2 6/2012 Calendrille
8,312,990 B2 11/2012 Gaspari et al.
8,328,596 B2 12/2012 Payne
8,381,334 B2 * 2/2013 Ballard ..... A47G 9/062 5/485
8,637,727 B2 1/2014 Moldonado et al.
8,727,110 B2 * 5/2014 Walsh ..... A45C 11/26 206/6.1
8,748,691 B2 6/2014 Maldonado et al.
8,763,181 B1 * 7/2014 Penfold ..... A47G 23/0306 5/420
8,915,354 B1 12/2014 Smith
D720,612 S 1/2015 Gilbert et al.
9,603,439 B2 * 3/2017 Nakamura ..... A45F 3/04
2003/0124948 A1 * 7/2003 Ostolaza ..... A45C 9/00 446/75
2003/0150149 A1 * 8/2003 Quick ..... A47G 1/0616 40/725
2006/0060314 A1 * 3/2006 Battista ..... A47H 1/022 160/330
2009/0068922 A1 * 3/2009 Brielmann ..... A63H 3/02 446/268
2009/0108036 A1 * 4/2009 Moore ..... A45C 13/02 224/153
2010/0092109 A1 * 4/2010 Rednour ..... A63H 3/50 383/6
2011/0059518 A1 * 3/2011 Bribach ..... A01G 9/025 435/266
2011/0068017 A1 3/2011 Feldman
2011/0156455 A1 * 6/2011 Fair ..... A63H 33/006 297/188.01
2012/0020586 A1 * 1/2012 Gilbert ..... A45C 9/00 383/4
2012/0138555 A1 * 6/2012 Ward ..... A45C 11/16 211/85.2
2012/0276803 A1 * 11/2012 Hernandez ..... A45F 3/04 446/75
2014/0263116 A1 * 9/2014 Wojciechowski .... A47F 5/0807 211/85.2
2015/0122672 A1 * 5/2015 Bouton-MacLaughlin ..... A45C 3/00 206/216
2016/0297229 A1 * 10/2016 Matyushenkova ..... A63H 3/10
2016/0367058 A1 * 12/2016 Ward ..... A47G 33/06
2017/0291112 A1 * 10/2017 Bayne ..... A63H 3/52

OTHER PUBLICATIONS

"Princess Castle Fold N'Go", http://www.toytainer.com/products/princess-castle-fold-n-go/, Internet printout dated Dec. 10, 2015, 2 pages.
Photograph of "Skylander" toy holder for hanging on a door, date unknown, 1 page.

* cited by examiner

TOY OR ITEM STORAGE, DISPLAY AND PLAY SYSTEM

CROSS-REFERENCE TO RELATED APPLICATIONS

This application claims priority to U.S. Provisional Patent Application, Ser. No. 62/344,173, filed Jun. 1, 2016, entitled Toy or Item Storage, Display, & Play System, the entire contents of which is hereby incorporated by reference in its entirety.

FIELD

The present inventions relate to the field of storage/display systems and devices. The present inventions more specifically relate to the field of toy/item storage systems.

BACKGROUND

Current popular methods for hanging toys vertically for storage purposes utilize methods designed/geared toward functionality. The focus of such systems is directed toward fitting many items in a compact space for storage in areas like closets. Examples of such systems include hanging columns of plastic or mesh shelves which hang from a clothes rod. Other examples include rows of clear plastic pockets which hang on the back of a door, so as to generally be out of sight. Additional examples of storage systems for toys include chains hanging from ceilings from which stuffed animals are suspended; nets hung in corners which hold items; and mounted strip(s) of wood to which dolls are clipped to hold them in place on a wall.

These systems suffer various drawbacks. For example, existing technology which involves hanging vertical storage is not designed for play with, or display of, toys, and in fact is often designed to be hidden. Moreover, existing devices/methods that may have hanging vertical storage properties utilize methods which limit the scope of appeal of the device, as they are not meant to be displays, consequently limiting the parameters of display of items they hold (e.g., clear plastic sleeves in rows cause all dolls to stand straight, facing one direction). These methods are functional, but not very decorative and also accentuate the fact that the toys are being stored and unused.

Furthermore, most children find it hard to keep their toys "picked up" and end up leaving them on the floor, on tables, etc., oftentimes resulting in lost or damaged toys. Moreover, toys in storage are not being used, and toys are often stored out of sight whenever possible. Accordingly, it is believed that if children, as well as adults, can play with/display/store toys all in the same location, they may be more willing and able to both play and keep toys picked up.

Accordingly, what is needed is a toy storage system in which toys may be played with or used, and in which the toys may be displayed while in storage.

SUMMARY

Accordingly, a novel toy storage, display, and play system is provided. The system combines and exemplifies several features including, but not limited to, decorative interactive artwork, play, display, and storage. Moreover, the decorative artwork feature has endless content/embodiment possibilities as it serves as an art medium.

One or more examples of an item storage, display, and play system are disclosed. The system includes a vertically hanging, interactive graphic artwork. The vertically hanging, interactive graphic artwork has a play area which also functions for display and storage of one or more items. The one or more items are integrated into one or more scenes on the vertically hanging, interactive graphic artwork.

One or more examples of an additional item storage, display, and play system are also disclosed comprising a vertically hanging, interactive graphic artwork. The vertically hanging, interactive graphic artwork is a multi-dimensional artwork scaled to correspond with a size of one or more items and forms a play area which also functions for display and storage of the items. The items are integrated into one or more scenes on the vertically hanging, interactive graphic artwork. A series of strategically placed item retention features are provided on the vertically hanging, interactive graphic artwork. A device for hanging the vertically hanging, interactive graphic artwork is also provided.

A toy storage, display, and play system is also disclosed. The system includes an interactive graphic forming an art medium. One or more retention features for placement and retention of one or more toys, such that the art medium simultaneously functions as a play area, a storage area, and a display area. One or more toys may be provided, engageable with the retention features such that the one or more toys form a multi-dimensional artwork and interact with a depicted scene in the interactive graphic.

Using the system described herein, individuals may play with toys and simultaneously display them on artwork. Consequently, the toys are already picked up when the child (or adult) is done interacting with the toys/items. Moreover, toys can be expensive and/or prized possessions. Displaying them, instead of hiding them, may be desired. Furthermore, displaying some toys, e.g., on the wall, frees up space on the floor taken up by storage, and increases the size of the play area without taking up floor space. Contrary to existing products that hang for storage, the system described herein stays where it is, hanging on the wall, and remains there as aesthetically pleasing interactive artwork while displaying and storing the toys. Moreover, without such toys there is no need to take the system down and find somewhere to store it as it still remains as artwork without toys or items upon it.

Other products for vertical storage focus on functionality and not aesthetics. In comparison, the system disclosed herein encompasses and combines interactive artwork with a system of play, display, and storage for toys and other items. The system disclosed combines imaginative toy play and display/storage with hanging works of art. Incorporating the toys/items into the artwork and methods of incorporating toys/items into the artwork disclosed herein are unique. Items are not just displayed or stored, but are interactive with a colorful, visually pleasing artistic background, which is limitless in its embodiment possibilities.

The invention described herein provides a place to store toys, and display expensive or prized toys. The system further provides visual incentive to play with the toys. Advantageously, the invention also limits the amount of time spent picking up toys and encourages such activity since the system serves multiple functions, including, but not limited to, both play and storage. The invention also provides a convenient way to store toys which does not take up valuable floor space.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
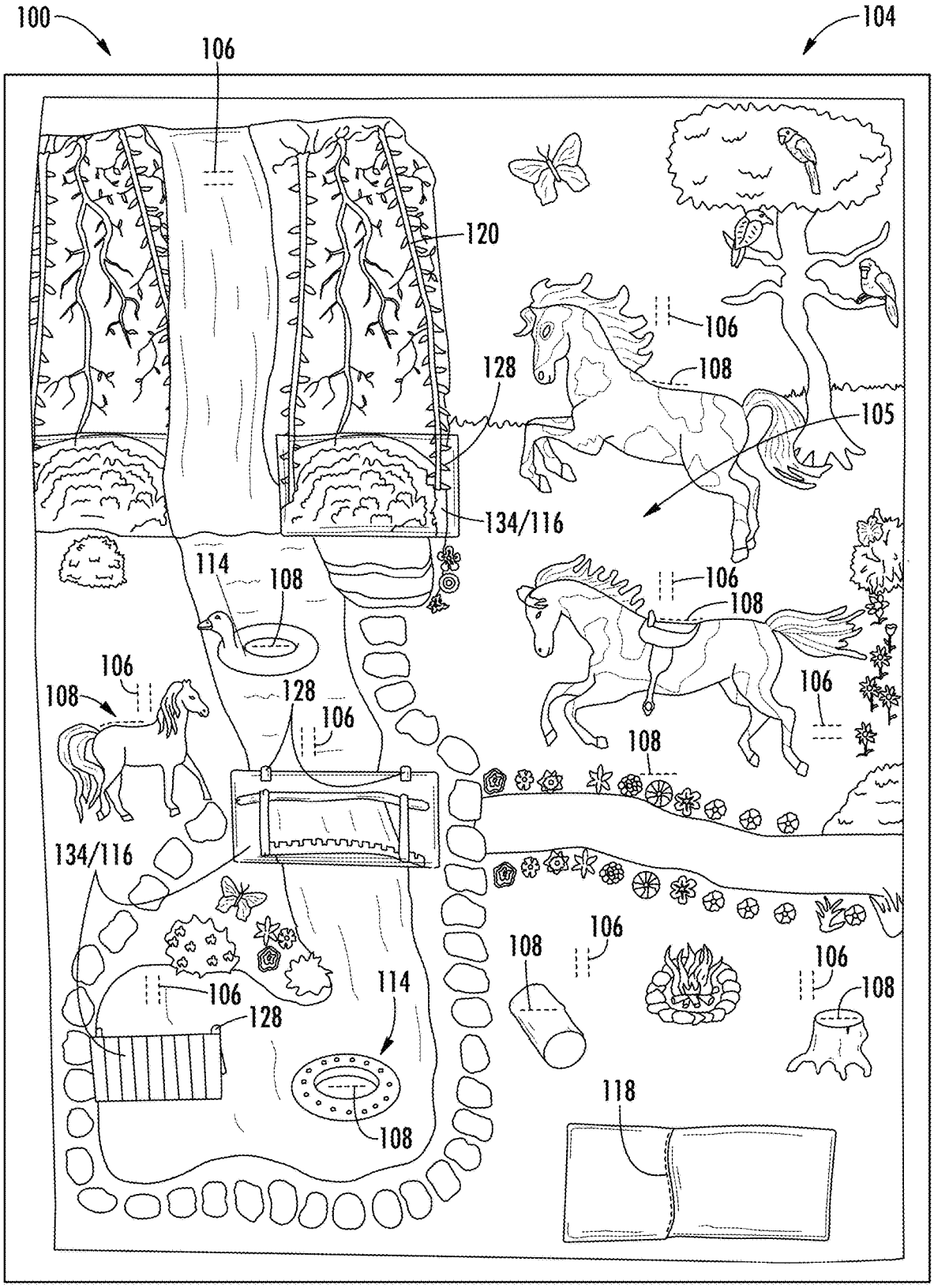
FIG. 1 illustrates one or more examples of embodiments of an item or toy storage, display, and play system as described herein, showing the system without toys or items thereon.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein. As the background feature is artwork, the options for the artistic embodiment of the art is as limitless as the imagination, as with any art medium.

DETAILED DESCRIPTION

Referring to the Figures, a novel toy/item storage, display, and play system is provided.

The system 100 is a combination of artwork, including multidimensional artwork, with a play area that also functions for display and storage (see FIGS. 1-2, 12-13). The system 100 integrates items 102, such as toys; including, but not limited to: fashion dolls, figures, action figures, animals, stuffed animals, and the like, into a vertically hanging, interactive, printed "graphic artwork" 104 (which may be multi-dimensional (e.g., 3D)) (see FIGS. 3-4). The graphic artwork 104 depicts scenes, pictures of content, context and the like which is created in a style and scale that corresponds to one or more toys or items 102, such that the toys or items are or may be integrated into the artwork 104 to interact with the scenes and activities being depicted on the artwork 104. While "toys" are specifically described herein by way of example, one of skill in the art would understand that the invention is not limited thereto. Any toy, article, item, and the like, which a user may desire to store and display in the manner described herein may be used with the various embodiments.

More specifically, the system 100 described herein comprises numerous visually pleasing, full color (or black and white) graphic scenes or pictures 105 (including in one or more examples of embodiments 3D graphics) depicted on durable, non-stretch textile, which may be a cloth-type material, such as, but not limited to: linen, cotton, canvas, toile, and the like. Preferably, the primary physical component is a material or textile of a durable, non-stretch nature which responds well to color printing, cutting, sewing, fabric stiffener, adhesive (such as used with VELCRO™). While fabric is specifically described, it is also contemplated that the material may be another printable material or material on which a graphic representation may be depicted such as plastic. While particular materials, such as fabric or plastic, and additions thereto (discussed herein below) are specifically described for purposes of example, one of skill in the art would understand that variations thereon may be made without departing from the overall scope of the present invention.

The material may be provided in various sizes. The artwork depicted on the material is designed or arranged to scale in size according to the size of the material or artwork 104, as well as to adapt the dimensions for use with various items 102, such as the toys described herein and other items, which may be placed into the artwork 104 or graphic representation on the material via various means so that such items 102 become a part of the artwork, graphic representation, scene 105 and/or picture.

The artwork 104 is a complete item in itself and may hang upon the wall as decorative artwork (see FIG. 1, 12). However, the artwork or graphic representation or scene 104, 105 contains features and components that allow for the strategic placement of various toys or items 102 such as (but not limited to), fashion dolls, stuffed animals, action figures, plastic animals, and the like, as described above, in such a manner such that they are incorporated into a multi-dimensional artwork or representation or scene 105, and are "in essence" interacting with the depicted scene 105, activity, and so forth (see FIG. 2, 13). Examples of such representations and interactions with toys include, but are not limited to, a figure riding a horse, petting an animal, sitting on a log, floating in a swim ring, climbing vines, sitting at a table, walking, and the like. Various examples of scenes 105 are also depicted in the representative examples shown in the Figures. Uniquely, the artwork 104 maintains, and toys or items 102 enhance, the multi-dimensionality of the original scene 105. Moreover, because the system 100 described herein incorporates toys or other items 102 into a piece of art, the artwork 104 becomes interactive—suitable for play, display, and storage of various toys/items 102.

More specifically, referring to FIGS. 1-10D, through a series of strategically placed vertical and/or horizontal apertures 106, 108, flaps 114, platforms 116, sleeves 118, straps or half-loop straps 120, loops 122, and the like, the multi-dimensional effect of the artwork 104 is enhanced and a play and storage/display system 100 is provided. As indicated, the artwork 104 or graphic representation or scene/picture 105 contains features and components that allow for the strategic placement of various toys/items 102. Vertical and horizontal button-hole type apertures 106, 108 of various lengths are strategically placed in the artwork 104 and are designed to incorporate items 102 or toys into the scene 105 or artwork 104. In the illustrated embodiments, this may be accomplished by sliding an appendage 124 of the toy or item 102 through the aperture 106 or 108 to hold the toy in the correct place and position in the scene 105, resulting in an interaction with the depicted scene 105 (various representative example illustrations of the item or toy as viewed from the rear of the artwork 104 are shown in FIGS. 9A-9B). More specifically, the material forming the artwork 104 may include vertical/horizontal button-hole-type apertures 106, 108 of various lengths placed strategically to hold toys/items 102 in designated appropriate places and positions.

Additionally, connected flaps 114 with button-hole apertures 106 or 108 of various lengths may be provided to hold a toy/item 102. Other features also include: fold down platforms 116, half-loops 120 secured to the material and into the scene 105, loose-hanging strips of cloth 122 and the like for toys/items 102 to hang on to (i.e. a vine), cloth sleeves 118, or pockets, and the like. Some added cloth features may be stiffened (e.g., treated with a fabric stiffener), colored and shaped according to the scene/picture 105. These features may be partially secured or attached (e.g., sewn or adhesively attached or attached with a mechanical fastener) onto the material or scene 105 so as to form a flap 114, which may optionally include a button-hole aperture 106 or 108 through which an object 102 can be partially inserted so as to be held in place, with a corresponding optional aperture 106 or 108 in the artwork 104. As a result, the toy/item 102 placed therein has the option to be "in front of" or behind the picture or scene 105 (see FIG. 2, FIG. 10D, which show a toy/item 102 behind the picture or scene 105, and FIG. 10B, which shows a toy/item 102 in front of the picture or scene 105).

Figure 7A:
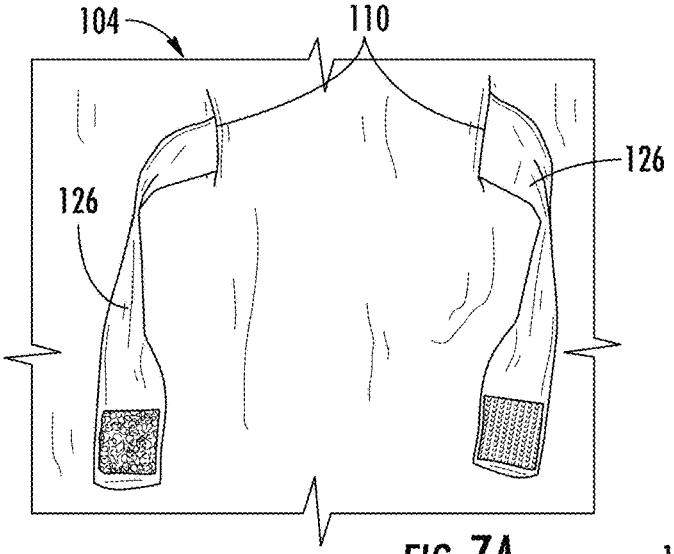
FIG. 7A illustrates one or more alternative examples of embodiments of a feature, showing a strip fed through the material of the item or toy storage, display, and play system from the back and attached or attachable in the front.
Figure 7B:
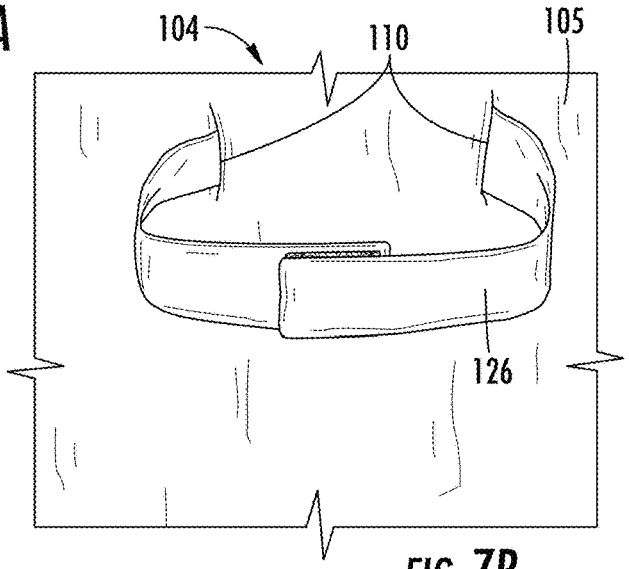
FIG. 7B illustrates the feature of FIG. 7A, showing the ends of the strip attached together.
Figure 7C:
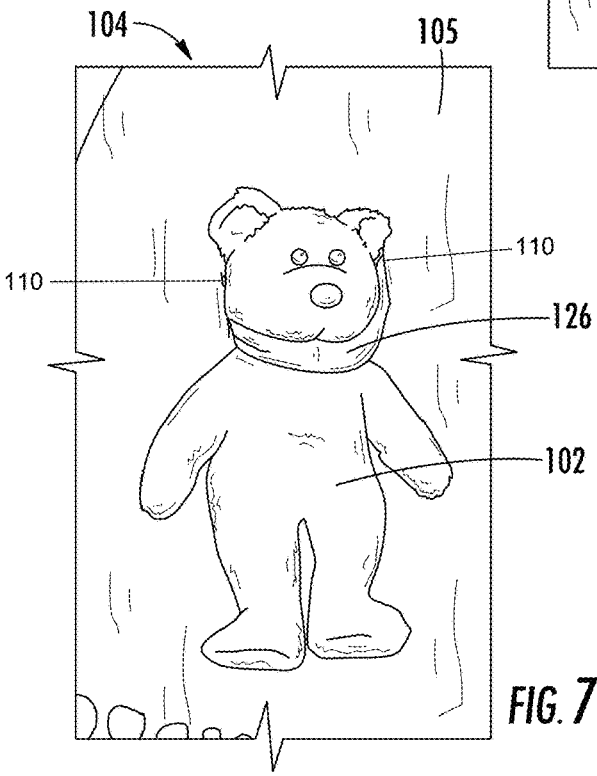
FIG. 7C illustrates the feature of FIGS. 7A-7B in use with an item or toy.
Figure 8A:
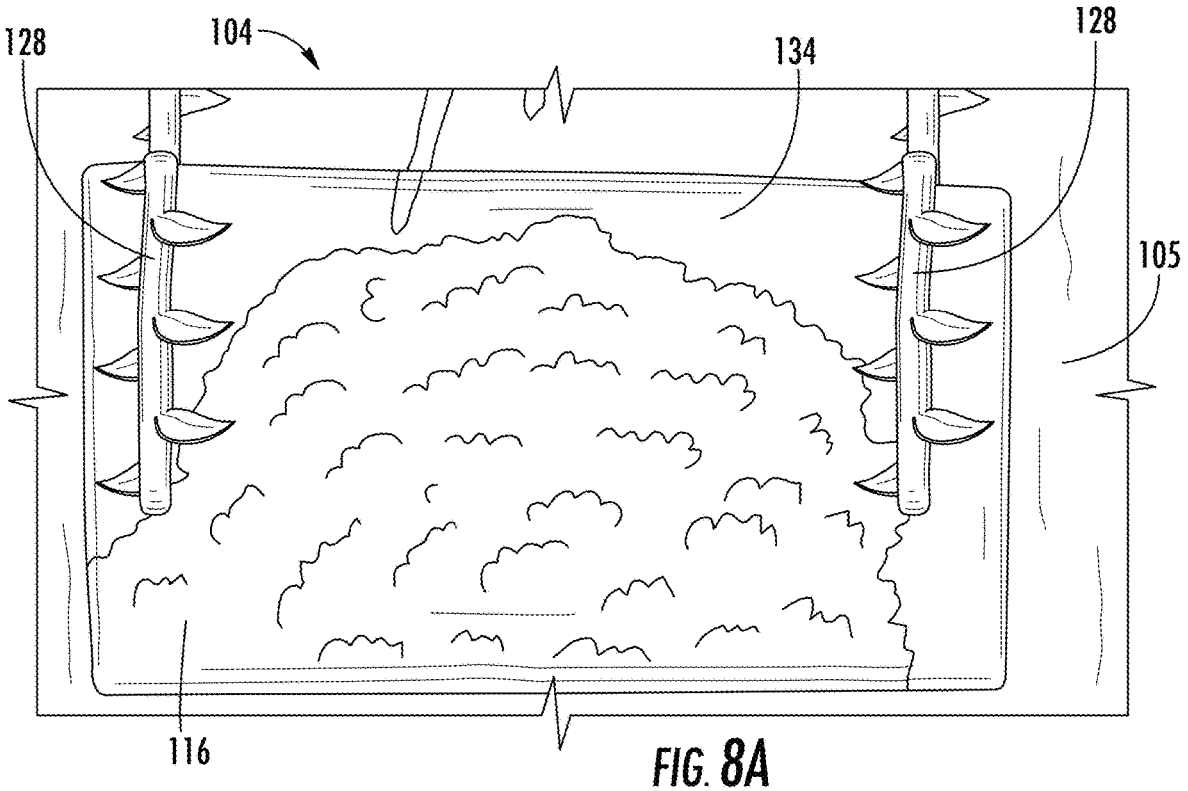
FIG. 8A illustrates one or more examples of embodiments of a feature, showing a platform attached to and usable with the material of the item or toy storage, display, and play system, showing the platform in the folded or "up" position.
Figure 8B:
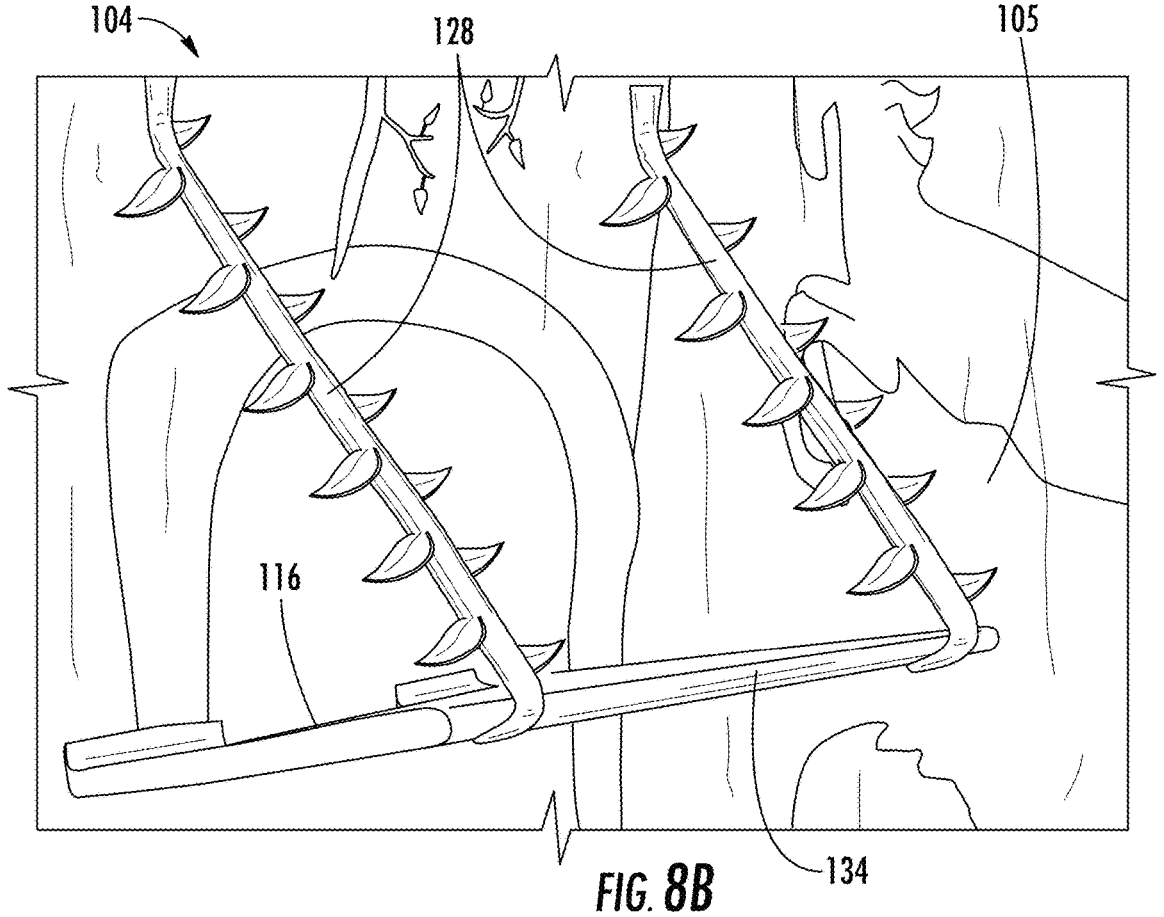
FIG. 8B illustrates one or more examples of embodiments of the feature shown in FIG. 8A, showing the platform in the extended or "down" position.
Figure 9A:
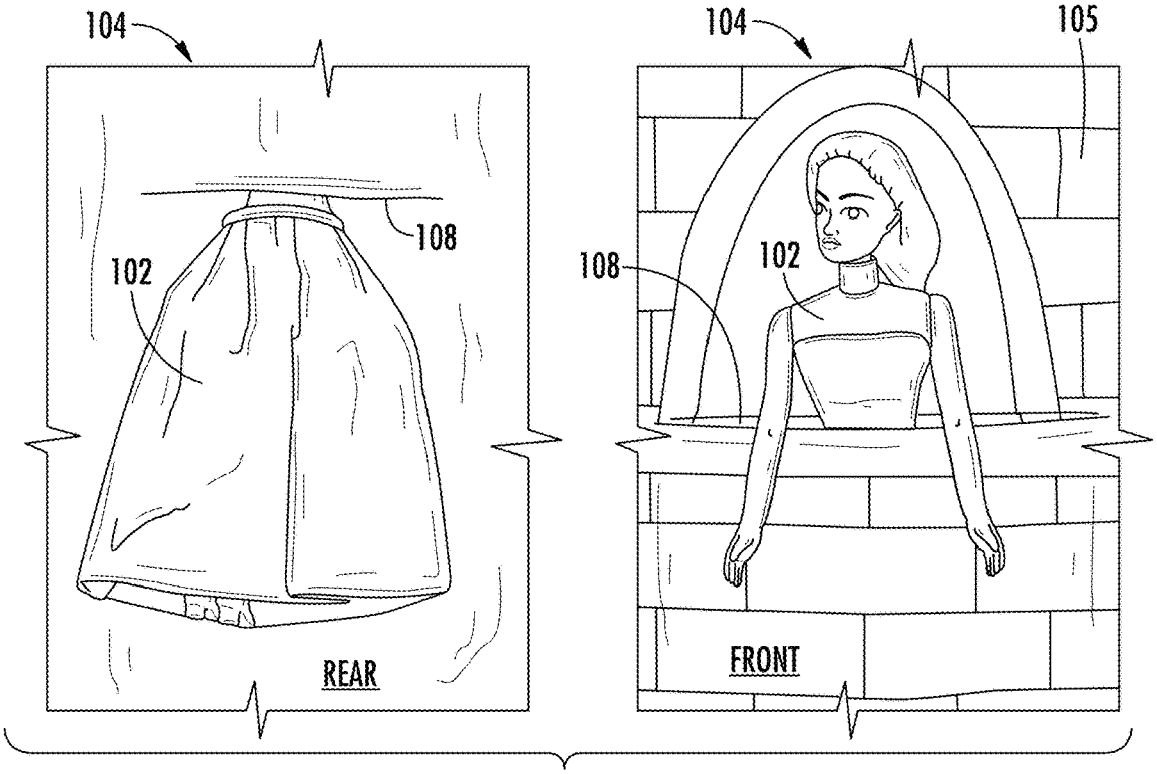
FIG. 9A illustrates various examples of views from the rear and front of the item or toy storage, display, and play system, when an item or toy is inserted in one or more apertures of the system.
Figure 9B:
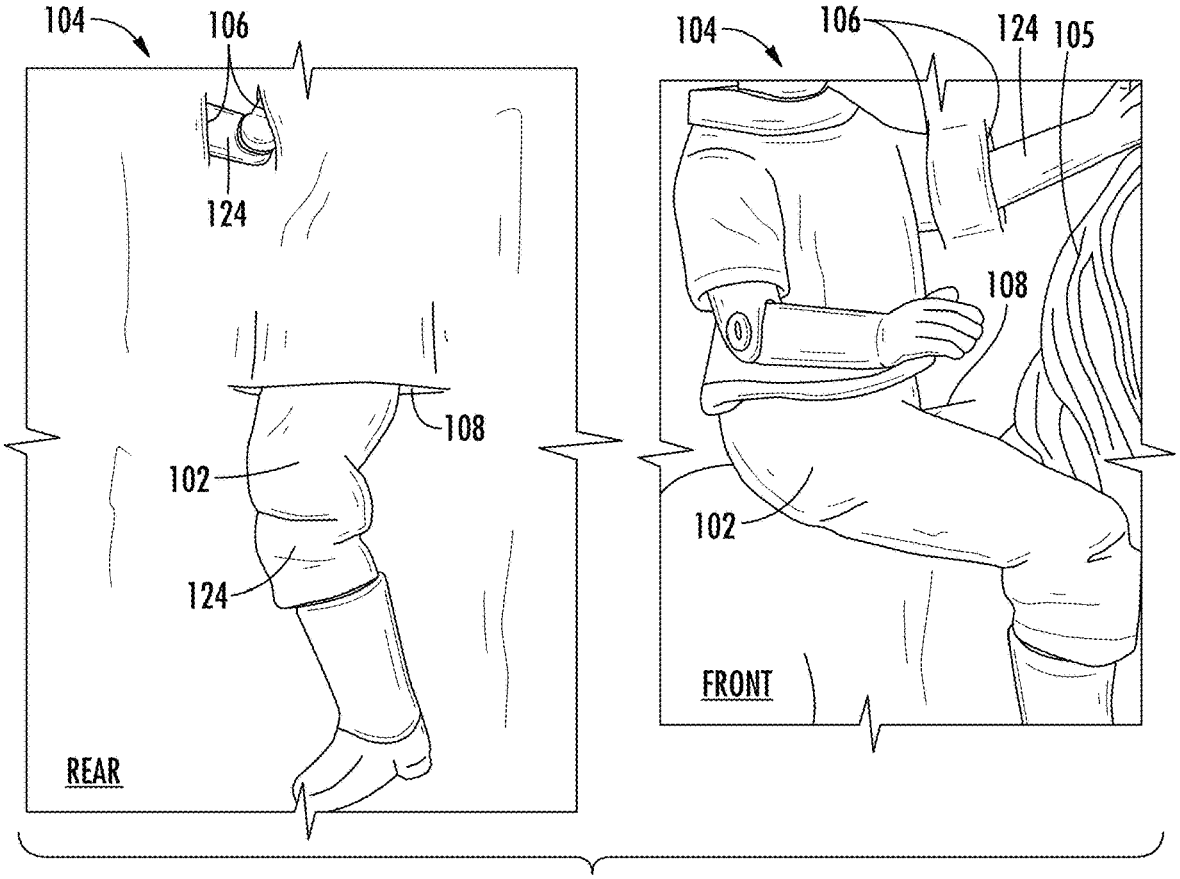
FIG. 9B illustrates various alternative examples of views from the rear and front of the item or toy storage, display, and play system, when an item or toy is inserted in one or more apertures of the system.
Figure 10A:
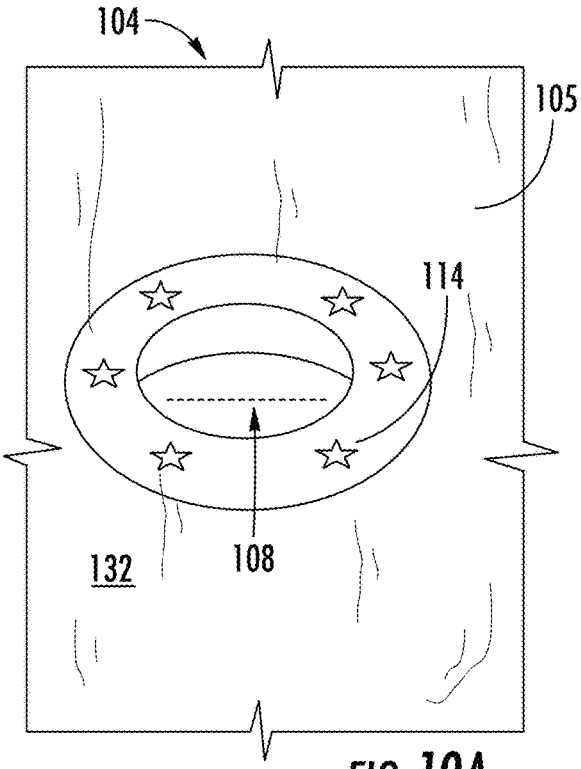
FIG. 10A illustrates one or more examples of embodiments of a feature of the toy storage, display, and play system, showing a flap with an aperture attached to and usable with the material of the item or toy storage, display, and play system.
Figure 10B:
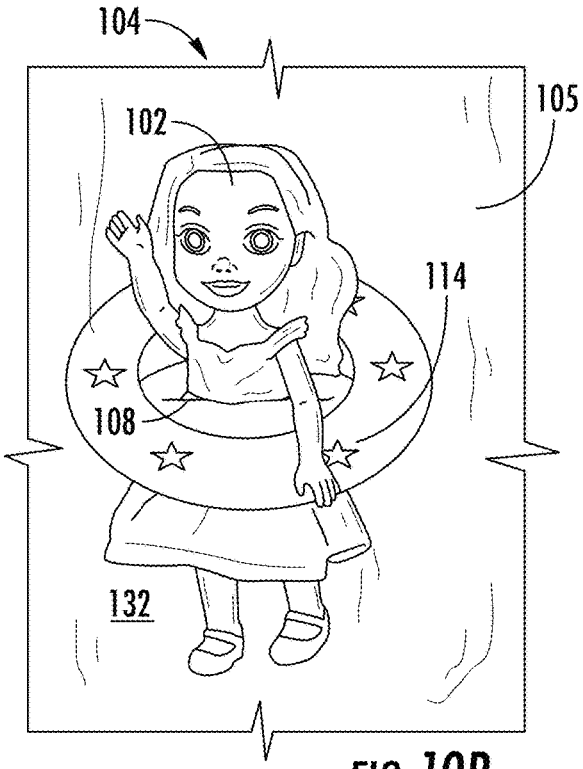
FIG. 10B illustrates one or more examples of embodiments of the feature shown in FIG. 10A in use with an item or toy, wherein the toy is visible below the flap.
Figure 10C:
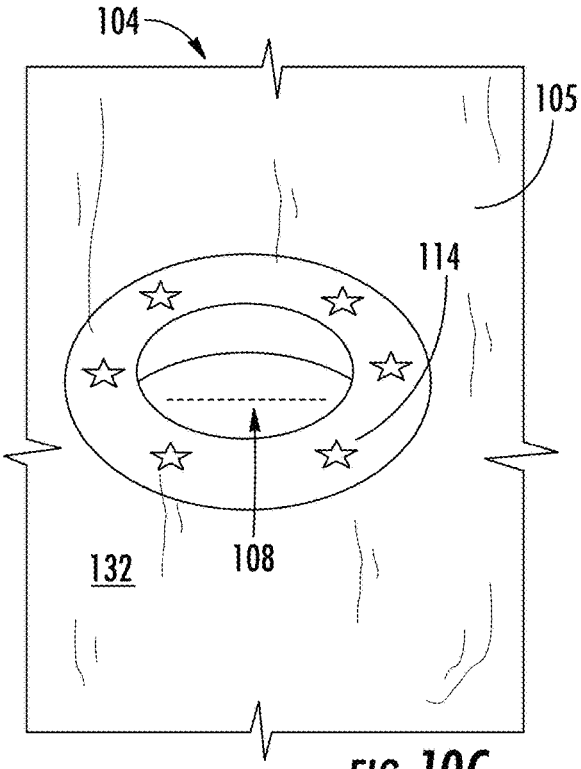
FIG. 10C illustrates one or more examples of embodiments of a feature of the toy storage, display, and play system, showing a flap with an aperture attached to and usable with the material of the item or toy storage, display, and play system.
Figure 10D:
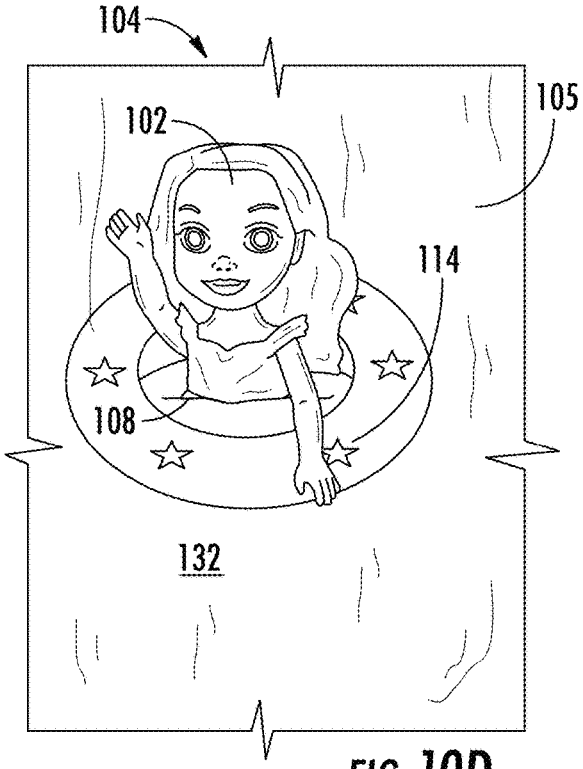
FIG. 10D illustrates one or more examples of embodiments of the features shown in FIG. 10C in use with an item or toy, wherein the toy is not visible below the flap as it is also inserted into the corresponding aperture on the material.

Vertical or horizontal strips 120, 128 of material matching the area and theme of the picture or scene 105 may also be provided. Sections of these strips 120 may be partially attached so as to form a slight, unclosed loop through which items 102 can slide so as to be held in place against the picture or scene 105 to create the visual effect that the item is interacting with the depicted scene 105 in the artwork 104 or to hang in place from the strip of material or loop 122, e.g., a vine or a rope (see FIGS. 6A-6D). Likewise, as shown in FIGS. 7A-7C, strips of material 126 attached or secured (e.g., sewn, adhered, mechanically fastened) onto the back of the artwork 104 and fed through to the front through apertures 110 may also be provided. These strips 126 may be fastened together with now known or future developed fasteners (e.g. VELCRO™) and may be arranged to retain or hold toys or items 102 in place by wrapping said strips 126 around the toy or item and securing the fastener. In this manner, the cloth strips can be left hanging behind the scene 105 if not needed and the button-hole apertures 106, 108 can still be utilized if desired.

Figure 3:
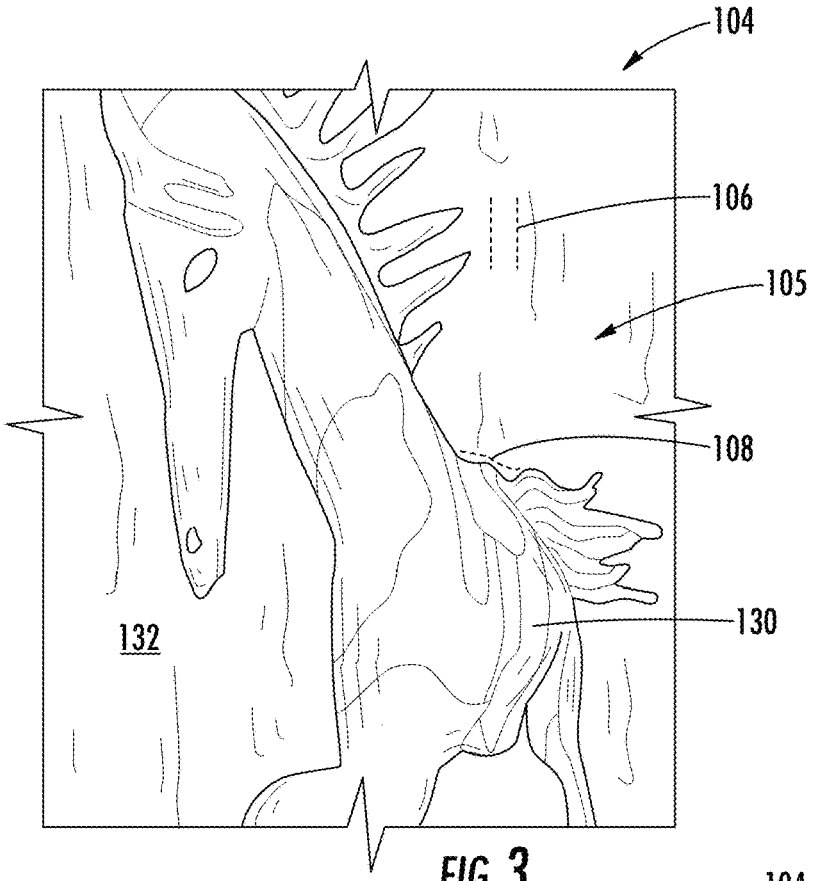
FIG. 3 illustrates one or more examples of a feature on the item or toy storage, display, and play system, showing an attached feature with stuffing to create multiple dimensions.
Figure 4:
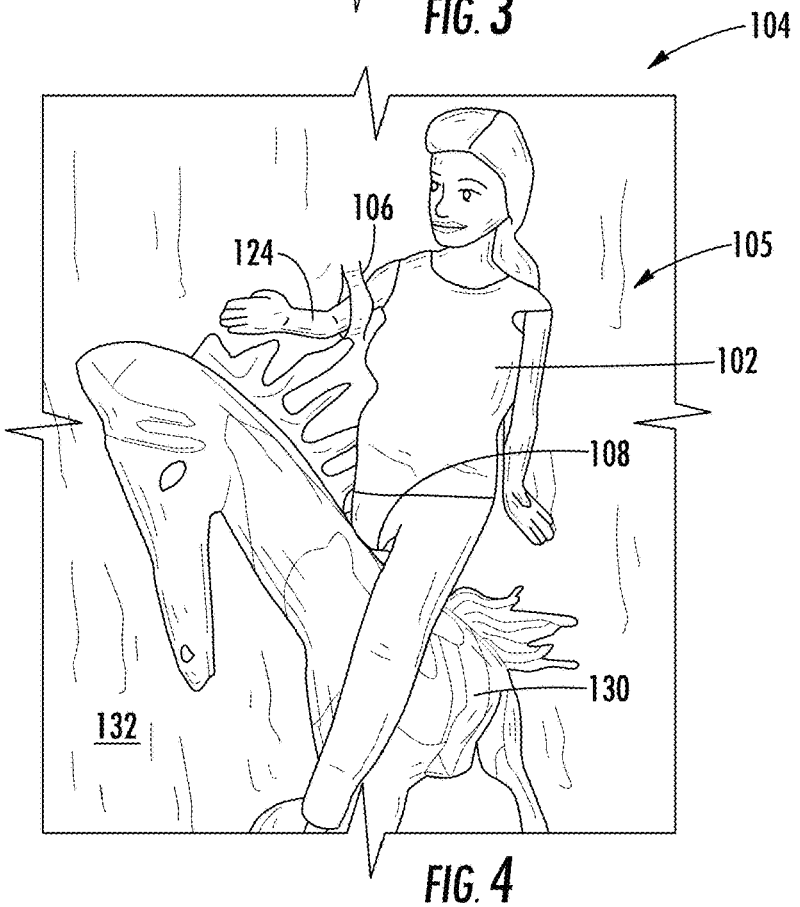
FIG. 4 illustrates the feature of FIG. 3, showing adjoining apertures in the item or toy storage, display, and play system and a toy retained thereon.
Figure 5A:
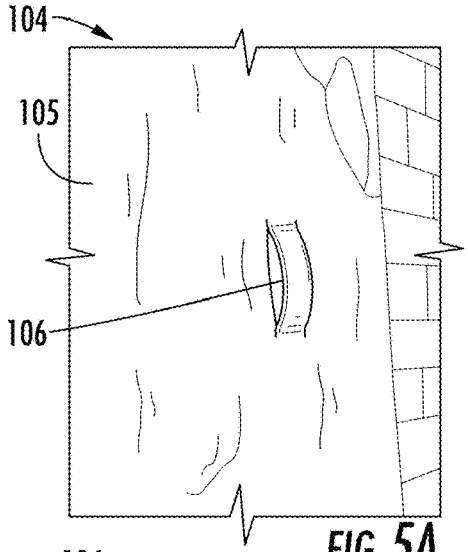
FIG. 5A illustrates one or more examples of embodiments of an item or toy storage, display, and play system as described herein, showing one or more vertical apertures in the artwork.
Figure 5B:
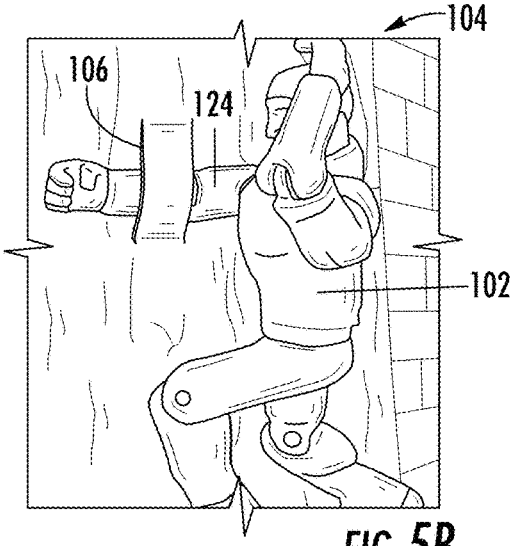
FIG. 5B illustrates the feature of FIG. 5A, showing adjoining apertures in the item or toy storage, display, and play system and an item or toy retained thereon.
Figure 5C:
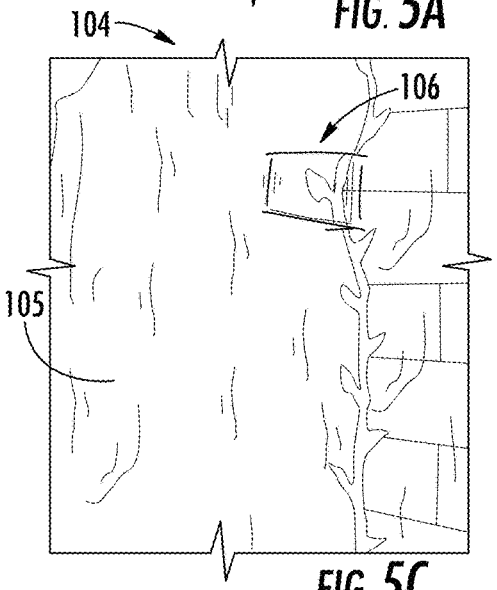
FIG. 5C illustrates one or more examples of embodiments of an item or toy storage, display, and play system as described herein, showing one or more horizontal apertures in the artwork.
Figure 5D:
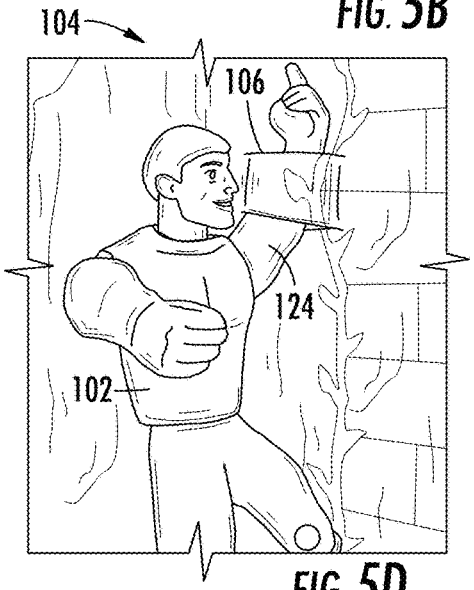
FIG. 5D illustrates the feature of FIG. 5C, showing adjoining apertures in the item or toy storage, display, and play system and an item or toy retained thereon.
Figure 5E:
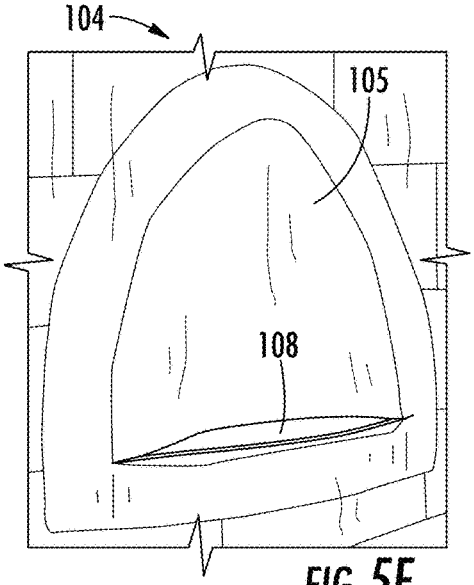
FIG. 5E illustrates one or more examples of embodiments of an item or toy storage, display, and play system as described herein, showing a horizontal aperture in the artwork.
Figure 5F:
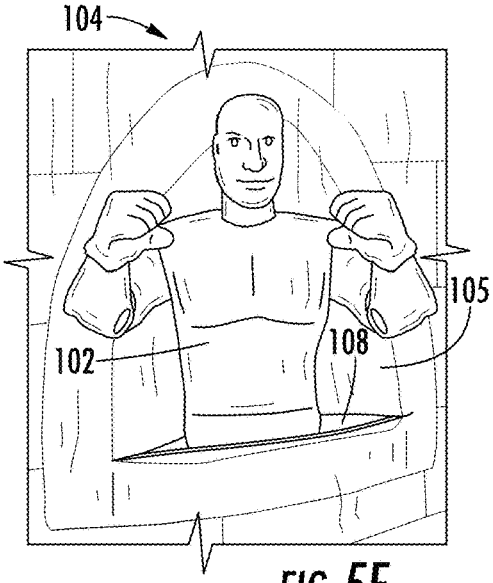
FIG. 5F illustrates the feature of FIG. 5E showing a horizontal aperture in the item or toy storage, display, and play system and an item or toy retained thereon.
Figure 6A:
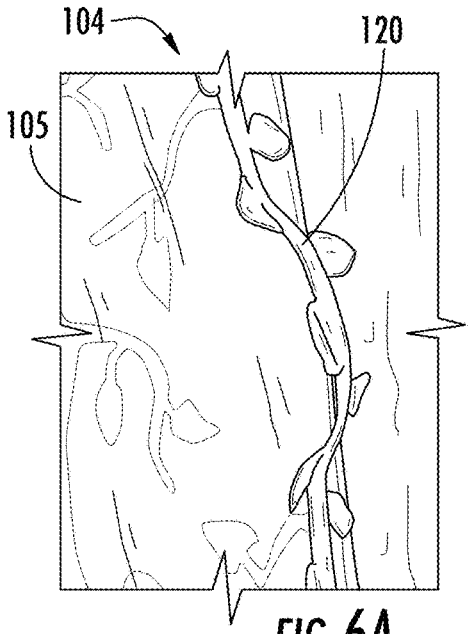
FIG. 6A illustrates one or more alternative examples of a feature, showing an attached strip to the material or scene of the item or toy storage, display and play system.
Figure 6B:
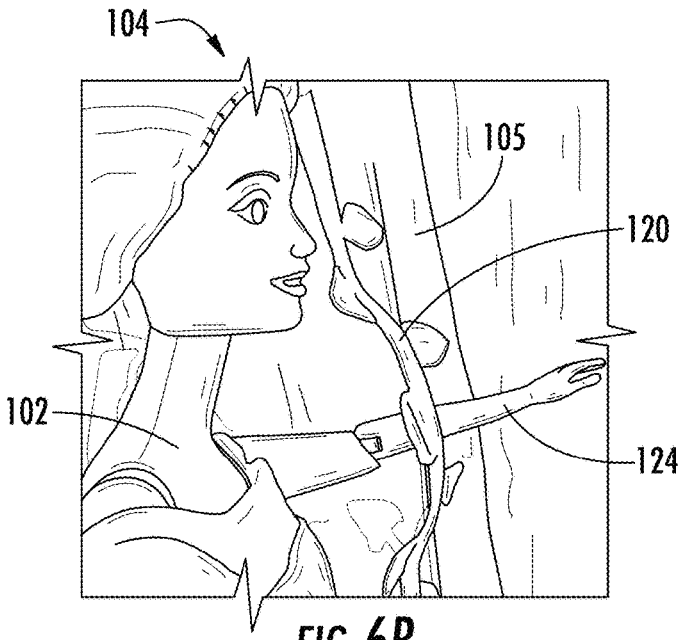
FIG. 6B illustrates the feature of FIG. 6A in use with an item or toy.
Figure 6C:
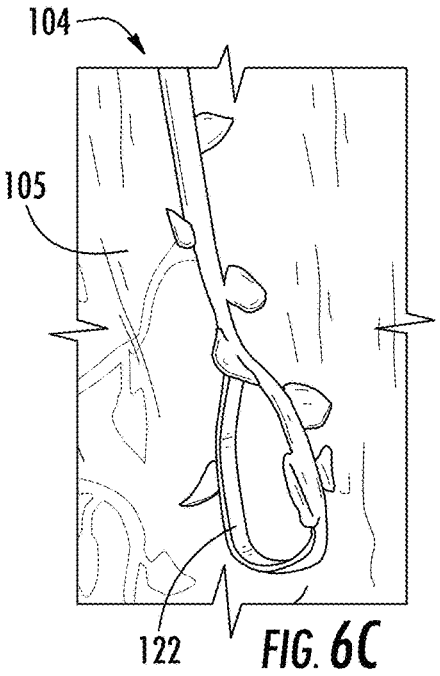
FIG. 6C illustrates one or more alternative examples of embodiments of a feature, showing a loop attached to the item or toy storage, display, and play system.
Figure 6D:
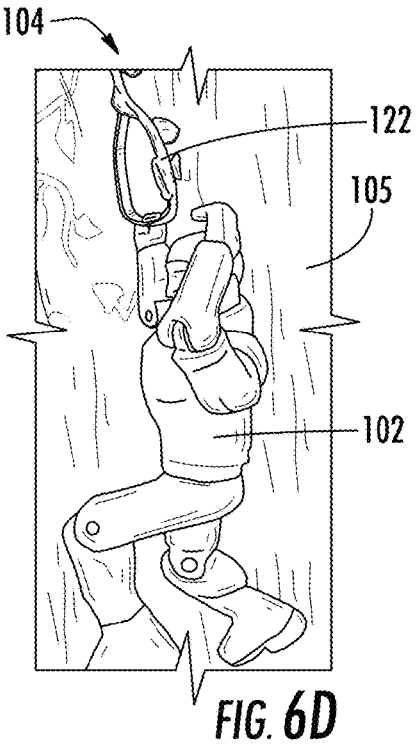
FIG. 6D illustrates the feature of FIG. 6C in use with an item or toy.

In one or more examples of embodiments, some features of a scene 105 in the artwork 104 (e.g., an animal, a pillow, a tree, a rock, and so forth) may contain or be provided with an extra dimension (see FIGS. 3-4 in which the illustrated horse 130 extends partially away from the surface 132 of the artwork 104). For example, a feature of the scene/picture 105 may be overlaid with a relevant layer of durable material (colored and/or shaped as required for the picture) and may optionally include, for example, a stuffing material between the layers. The multiple layers may be secured together in any suitable manner, such as but not limited to, glue, adhesive, or sewing. These additional materials provide the feature being attached with more dimension (see FIGS. 3-4).

As discussed above, the artwork 104 may also include one or more interactive features such as platforms 116 (FIGS. 1-2, 8A-8B). In the illustrated examples of embodiments, platforms 116 are formed by folding down a sleeve of cloth 134 attached (e.g., sewn, adhered, or mechanically attached) to the artwork 104 and depicting or forming a part of the artwork 104. For example, the platform 116 may be retained or held in place by two edges being attached or sewn to the artwork 104 and forming a cloth sleeve open on one or two sides and encasing a piece of cardboard or sturdy light-weight plastic or other rigid material to reinforce the cloth sleeve. When folded down the platform 116 at least partially hangs from cloth or other material strips 128 designed to match the artwork 104 so that toys or other items 102 can be placed upon the platform(s) and interact with the artwork 104, or otherwise form a part of the artistic work. The platform 116 may also be supported by material connecting the platform and artwork background. In one or more examples, the platform 116 may be folded up, and to this end may also contain relevant artwork 104 on an additional surface 134. When folded, the platform 116 may be retained in position by VELCRO™, magnets, or other separable attachment mechanisms.

Figure 2:
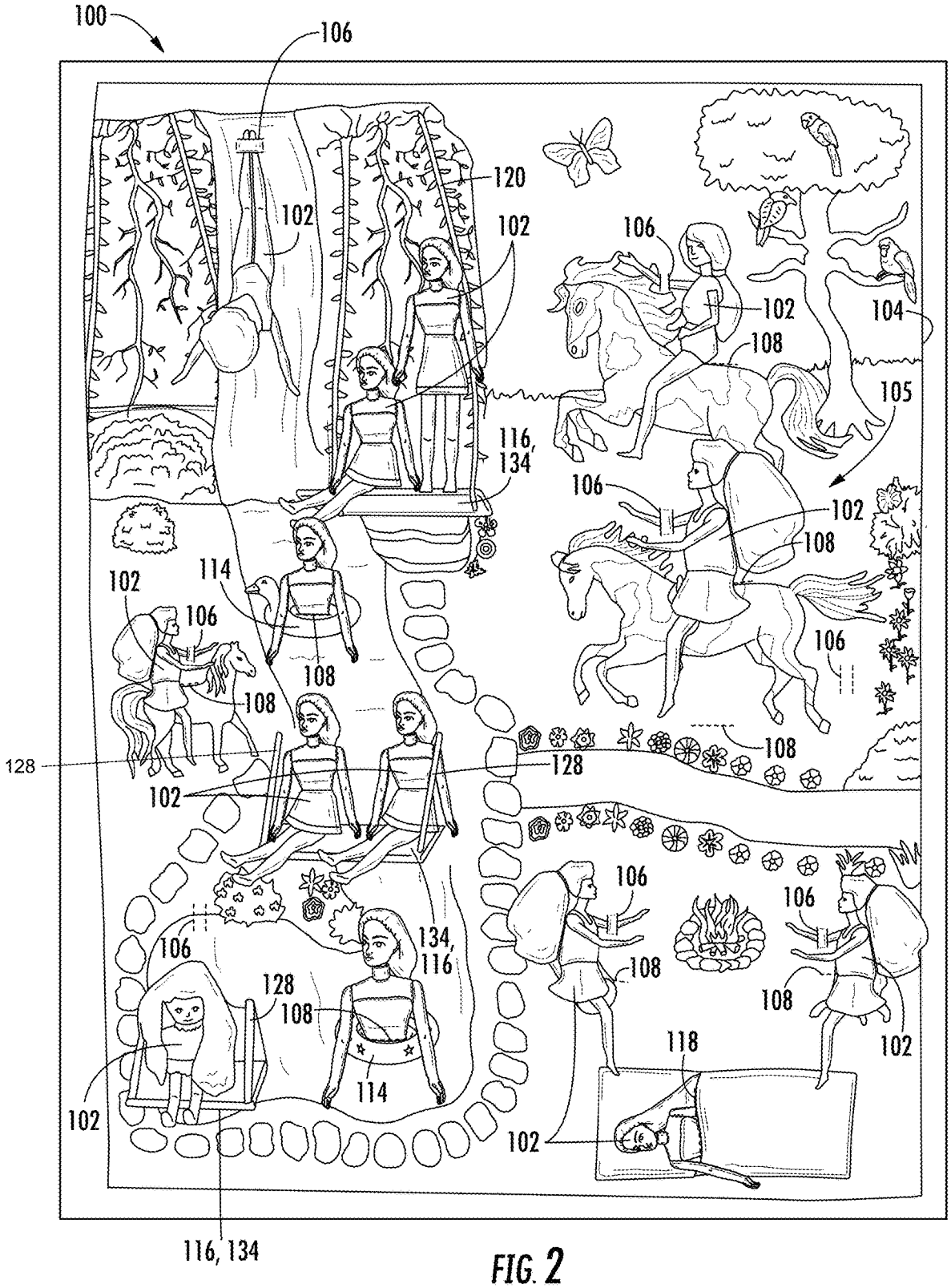
FIG. 2 illustrates the item or toy storage, display, and play system of FIG. 1, showing one or more toys or items thereon.

In another example of embodiments, cloth or other material sleeves 118 or pockets can also be provided on the artwork 104 or material. For example, such sleeves 118 may be used to depict an article of like shape, such as a bed or a sleeping bag, or the like such as shown in FIGS. 1-2.

While cloth and fabric are specifically described for purposes of example, one of skill in the art would understand that variations thereon may be suitable for the purposes provided. As a non-limiting example, plastic structures may be used in place of the cloth material.

Figure 11A:
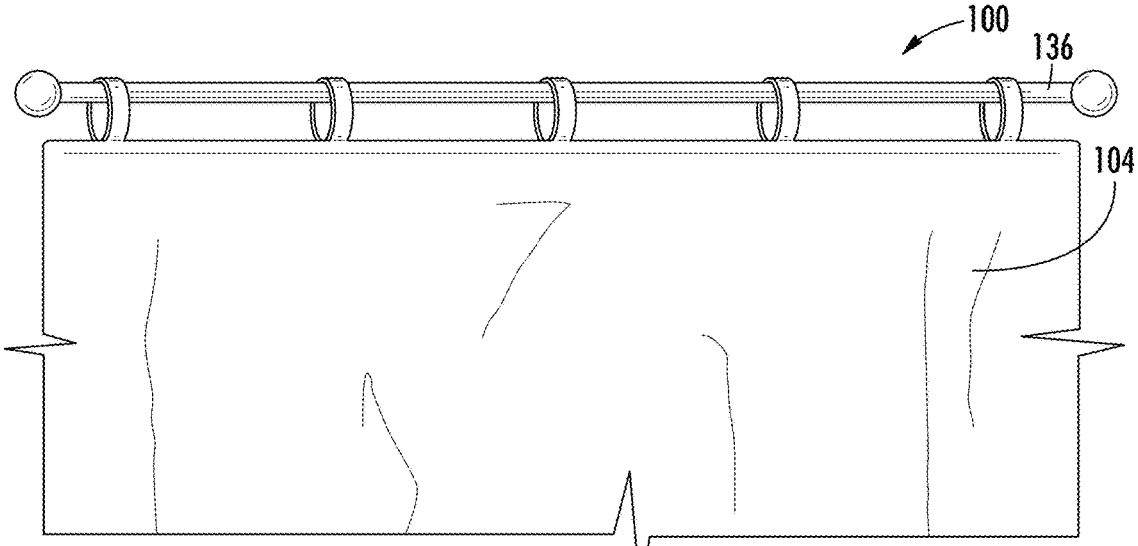
FIG. 11A illustrates one or more examples of embodiments of a mechanism for hanging the item or toy storage, display, and play system.
Figure 11B:
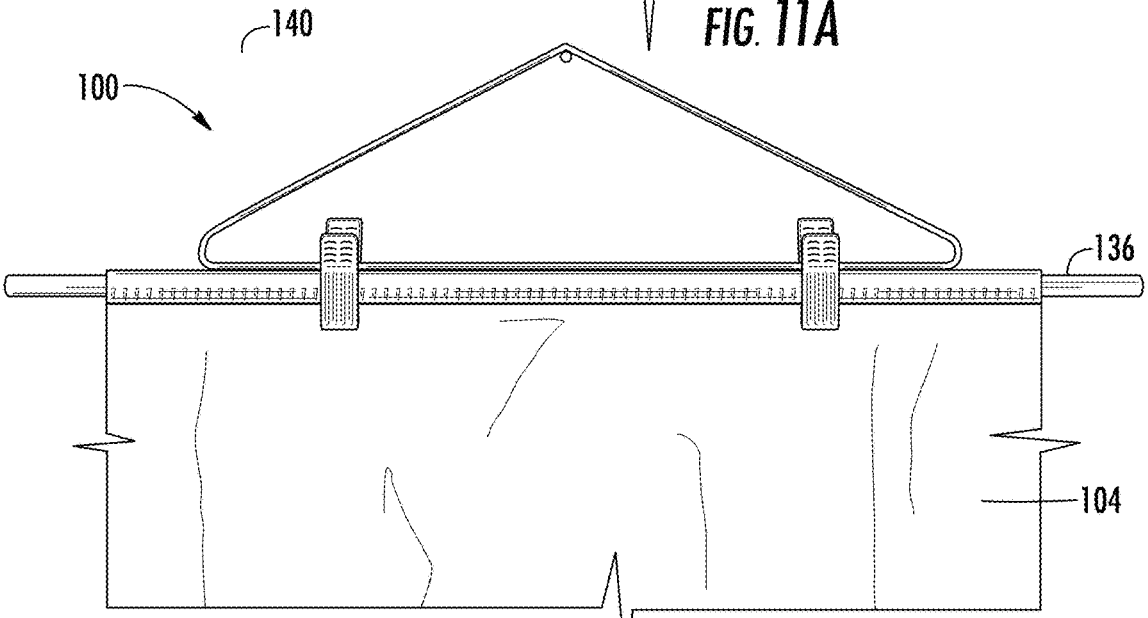
FIG. 11B illustrates one or more alternative examples of embodiments of a mechanism for hanging the item or toy storage, display, and play system.
Figure 11C:
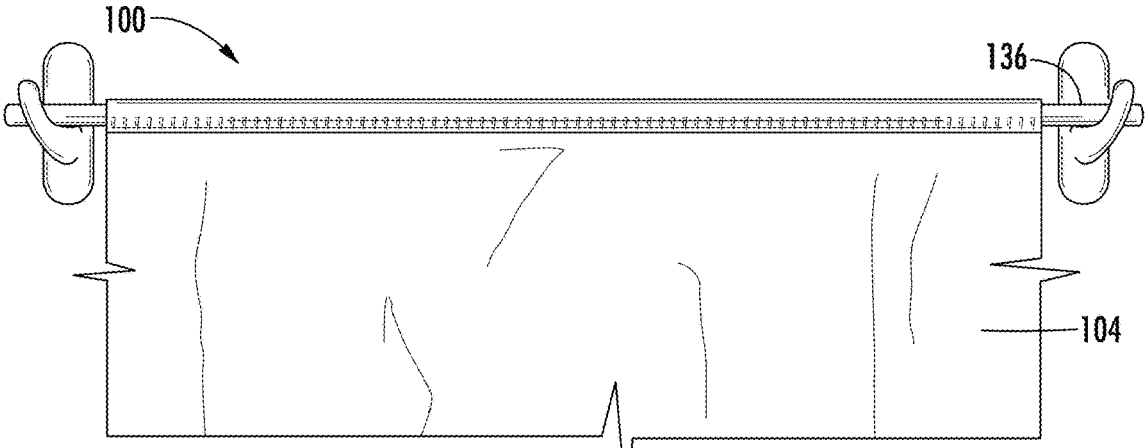
FIG. 11C illustrates one or more alternative examples of embodiments of a mechanism for hanging the item or toy storage, display, and play system.
Figure 11D:
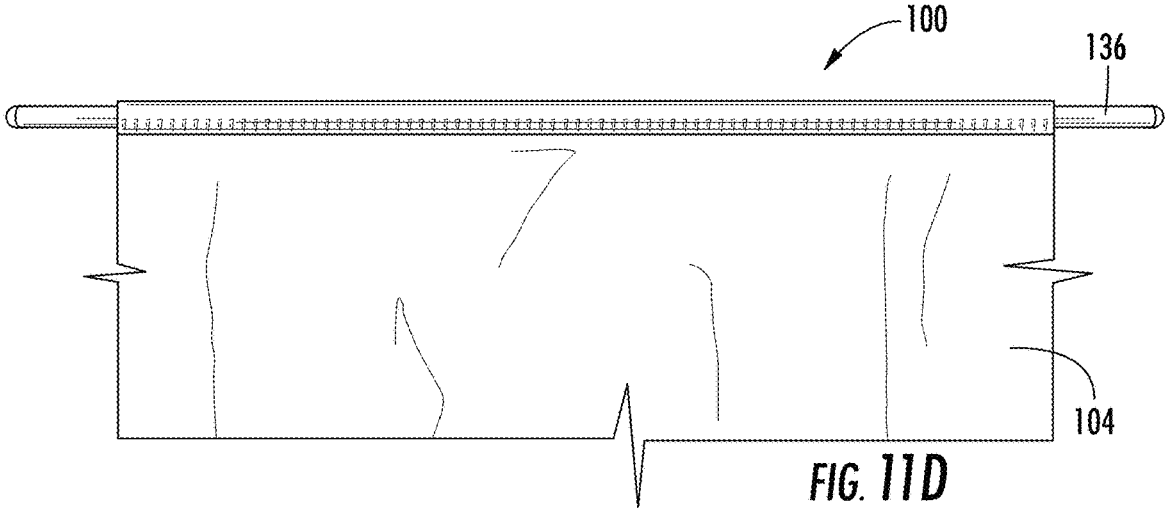
FIG. 11D illustrates one or more alternative examples of embodiments of a mechanism for hanging the item or toy storage, display, and play system.
Figure 11E:
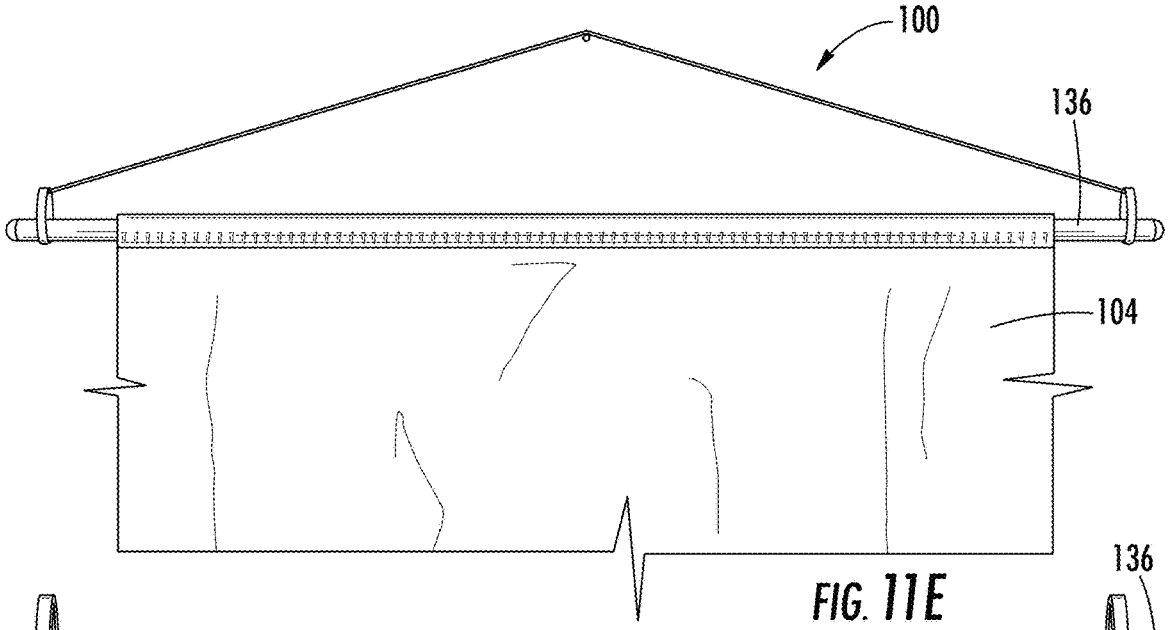
FIG. 11E illustrates one or more alternative examples of embodiments of a mechanism for hanging the item or toy storage, display, and play system.
Figure 11F:
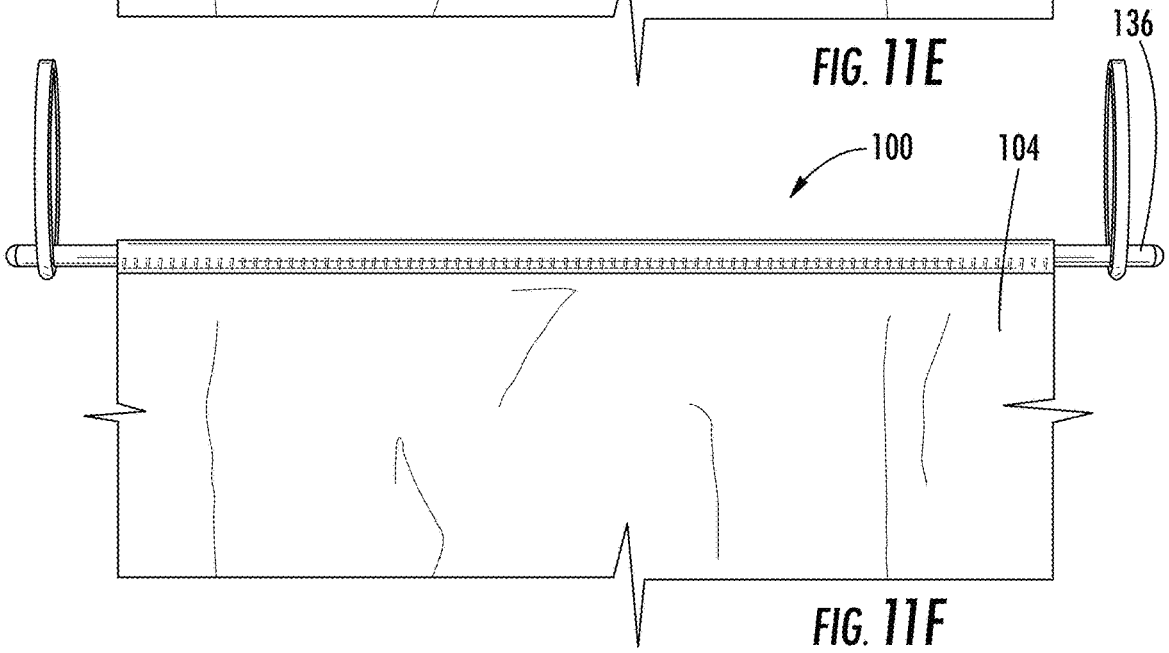
FIG. 11F illustrates one or more alternative examples of embodiments of a mechanism for hanging the item or toy storage, display, and play system.
Figure 12:
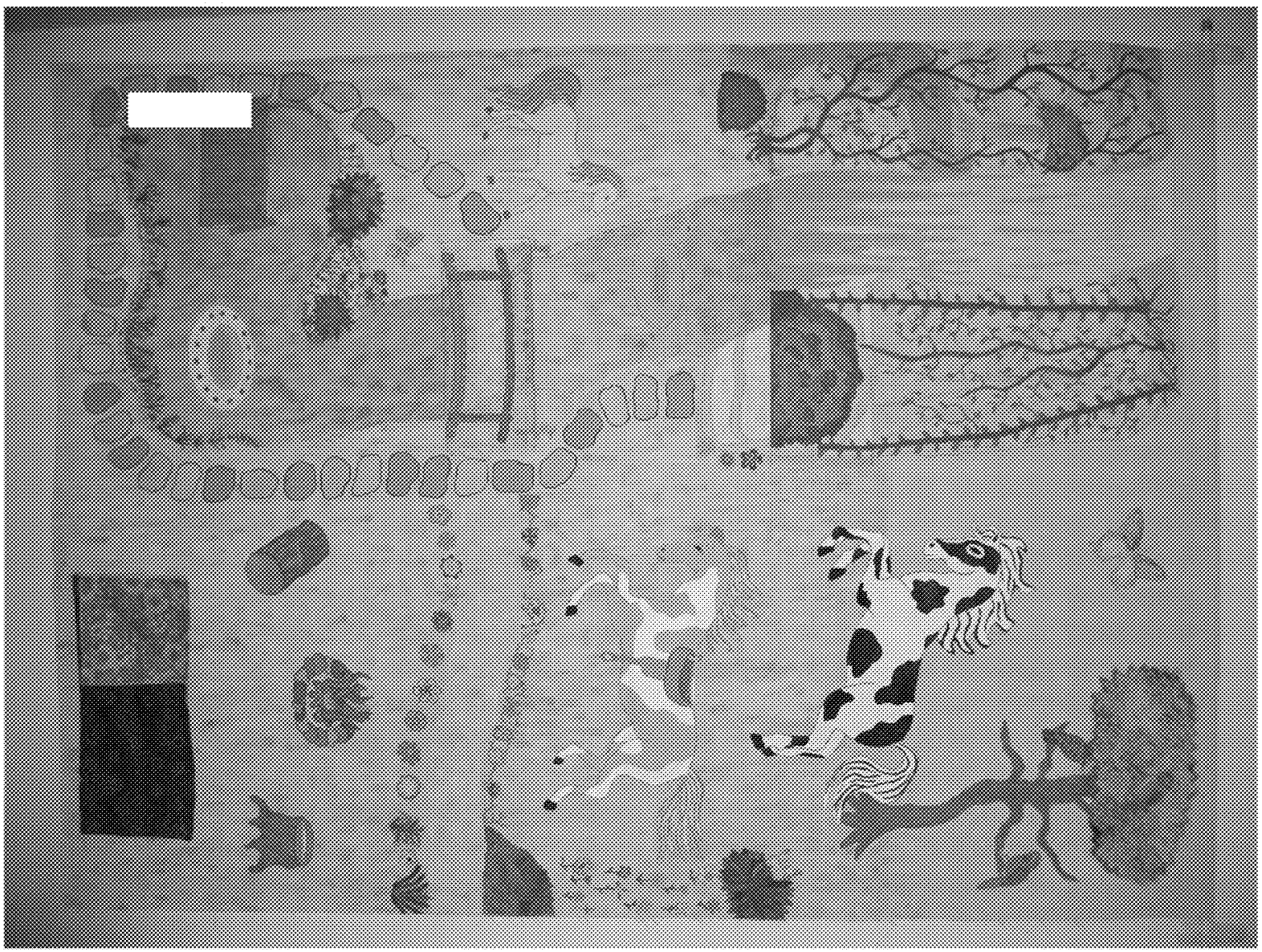
FIG. 12 is a photograph showing one or more examples of the item or toy storage, display, and play system of FIG. 1, showing the system without toys or items thereon.
Figure 13:
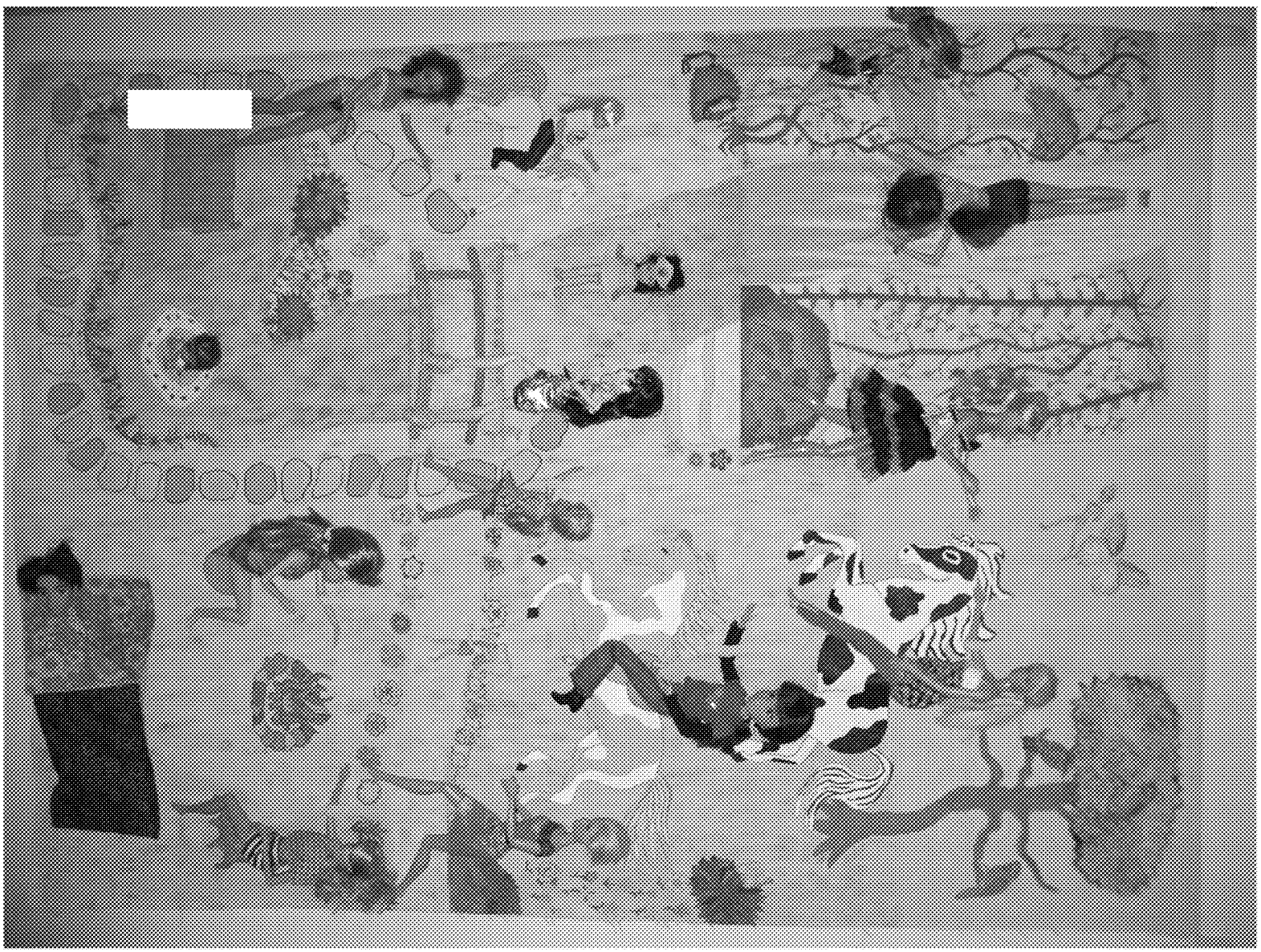
FIG. 13 is a photograph showing one or more examples of the item or toy storage, display, and play system of FIG. 2, showing the system with toys or items thereon.

The artwork 104 (i.e., the system) may be hung or retained on a surface in various manners. For example, as can be seen in FIG. 11A, the material may be hung in a tapestry-type manner. The artwork 104 may be provided with a plurality of connected loops along an edge, such as shown in FIG. 11A, through which a rod or dowel 136 may be inserted. Alternatively, the artwork 104 may be provided with one or more pockets along an edge, such as shown in FIGS. 11B-11F through which a rod or dowel 136 may be inserted. To this end, a dowel 136, one or more durable strings or cords to hold the dowel, or equivalents (e.g., a folding tent-pole type of pole; a round expandable curtain rod) may be used to hold the material or may otherwise be provided for hanging the artwork 104. Alternatively, as shown in FIG. 11B, a clip-type structure 140 may be used with a corresponding wall hanging device for removable attachment of the artwork 104 from the hanging device. While a particular method of hanging the system is specifically described, variations thereon would not depart from the overall scope of the present invention.

The system described herein, and in particular the graphic artwork 104, is combined with various methods and/or devices for placement and retention of toys/items 102 such that the toys or items 102 become part of the artwork 104. The artwork 104 functions as a play area, storage area, and display area. Not only does the end user contribute to the artistic work by addition of one or more toys/items 102, but the end user may also use it for play, display, and storage of such toys/items 102.

As indicated, the toys or items 102 in one or more examples of embodiments are inserted into the artwork 104 in one or more strategically placed apertures 106, 108 of various lengths, or placed on one or more other features described above, such as shelves and the like. These features allow a toy 102, such as a fashion doll, to appear to be engaged in the activity or scene 105 depicted on the artistic work—which is already a completed work—interacting, joining, and enhancing the work. Moreover, the toys or items 102 are not permanently attached to the artwork 104 and are interchangeable.

In one or more example of embodiments, the artwork 104 may be formed by printing a graphic (multi-dimensional work included) on the material described herein. The scenes or images or pictures 105 of the artwork 104 are designed according to scale for various sized toys/items 102 so as to depict or correspond with various play or activities in which the toys will appear to be engaged, or will be engaged, when attached to the artwork 104, examples of which are shown in FIGS. 1-2. As indicated, parts or portions of toys or items 102 may be slid through apertures 106 or 108 or supported in or on the various components described above to hold them in place/position.

Referring generally to FIGS. 1-10D, the artwork material is cut with vertical and/or horizontal button-hole style apertures 106, 108 (of various lengths) in strategic places, according to the artwork depicted, the type of article or toy it will be holding, and the relative position(s) of the toys relative to the scene 105 in the artwork 104. These apertures 106, 108 may be reinforced around the edges, e.g., by sewing or other means. Various additional features may be added to the material. For example, durable cloth features of the picture may be added by sewing or adhesive at the time of manufacture, and colored and shaped as required for the artistic work with stuffing and the like to create dimension. Decorative flaps 114 may be made by attaching (e.g., partially sewing) an appropriately shaped and colored piece of material—which may be treated with a fabric stiffener—to the artwork 104. One or more button-hole aperture(s) 108 may also be provided in the feature (e.g., flap)-which may correspond with an aperture in the artwork 104—through which a toy or item 102 can be inserted to interact with the picture. Vertical or horizontal strips of material 128 matching the area and theme of the picture may also be added. Such strips 120 may be partially attached so as to form a slight, unclosed loop through which items 102 can slide so as to be held in place against the artwork 104 to engage the item into the artwork 104. In addition, one or more loops 122 or strips for hanging items 102 may also be attached. Vertical/horizontal strips 126 may be sewn onto or inserted through the back of the artwork 104 and fed through to the front, through apertures 110. These strips 126 may be fastened together with VELCRO™ so toys can be held in place. In this manner, the cloth strips can be left behind the scene/picture 105 if not needed and the button-hole apertures can still be utilized if desired. One or more platforms 116 may be formed by folding down a flap of cloth sewn to the artwork 104, depicting a part of the artwork 104, and held in place by two edges attached to the artwork 104. This forms a cloth sleeve which is open on one or two sides. A piece of cardboard or sturdy lightweight plastic to reinforce the cloth sleeve may be inserted/encased into the sleeve. Strips 128 may be attached to the platform 116 and artwork 104 to at least partially support the platform. When folded up, as designated by reference 134, the platform stays in place with the use of VELCRO™ or magnets sewn in place. Sides can also be used to support the platform, made in a triangle configuration to attach the artwork 104 or scene and the platform sleeve. Sleeves 118 (or pockets) may also be attached or sewn on vertically or horizontally to hold a toy or item. In one example, the sleeve is printed according to the artwork 104 depicted in the scene/picture 105.

While specific examples of various embodiments are provided herein above, modifications thereon may be made without departing from the present invention. For example, one or more specific mechanisms for retaining toys or items are disclosed above. In a further alternative, a colorful background with clear plastic pockets may be used. The material may also include one or more items or toys to be assembled with the artwork. More, or fewer, features of the design may be removable or movable. An alternate, non-flexible material may also be used for the background. Alternatively, the entire image shown in the material may be padded like a quilt. Likewise, the edges of the material may be colored to look like a picture frame. Additional features may also be added, such as but not limited to, a battery operated string of lights. The invention herein may also be made portable.

The system described herein has various advantages over existing systems and devices. For example, the system may be used and stored in the same location while also serving as artwork, a play area, a display, and a storage area. Moreover, if hung behind a doll house or other play structure, it enhances the play area. After play time, it stays in place to be a decorative background to the doll house or other structure while displaying and storing the toys. The system also increases play area and storage without taking up floor space. While items are being stored, they are also being displayed on an aesthetically pleasing background. In comparison, existing storage devices are not meant to be artistically pleasing, nor meant to be play area and display medium at the same time.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. An item storage, display, and play system for three-dimensional items to be posed and placed on the system, the item storage, display, and play system comprising:

a multidimensional artwork having a decorative graphic, the decorative graphic depicting a scene with activities, the three-dimensional items to be posed and placed on the multidimensional artwork within and interacting with the activities depicted in the scene, the multidimensional artwork being a vertical wall hanging with a durable, flexible non-stretch linen textile;

a series of strategically placed item retention devices permanently incorporated into the multidimensional artwork in the scene, the series of strategically placed item retention devices comprising cooperative slits including a first slit and an adjacent second slit, a flap and a cooperative third slit, a singular standalone fourth slit, and a fold down platform, the cooperative slits removably retains a first three-dimensional item of the three-dimensional items such that a first portion of the first three-dimensional item is visible on a first side of the multidimensional artwork, a second portion of the first three-dimensional item is obscured from view on a second side of the multidimensional artwork, a third portion of the first three-dimensional item is visible on the first side of the multidimensional artwork, and the second portion is between the first portion and the third portion, the flap and the cooperative third slit removably retains a second three-dimensional item of the three-dimensional items such that a first portion of the second three-dimensional item is visible on the first side of the multidimensional artwork and a second portion of the second three-dimensional item is obscured from view on the second side of the multidimensional artwork, the singular standalone fourth slit removeably retains a third three-dimensional item of the three-dimensional items such that a first portion of the third three-dimensional item is visible on the first side of the multidimensional artwork and a second portion of the third three-dimensional item is obscured from view on the second side of the multidimensional artwork, and the fold down platform removeably retains a fourth three-dimensional item of the three-dimensional items, the fold down platform at least partially hangs from a material strip; and a device for vertically hanging the multidimensional artwork in close proximity to a wall;

wherein each item retention device of the series of strategically placed item retention devices removeably retains each three-dimensional item freely in place so that the three-dimensional items are not made secure to the multidimensional artwork;

wherein each three-dimensional item of the three-dimensional items has no attachment device for making secure to the multidimensional artwork;

wherein the multidimensional artwork further functions as a storage area, a display area, and a play area for the three-dimensional items; and wherein the multidimensional artwork is a complete decorative artwork with or in absence of the three-dimensional items.

2. The item storage, display and play system of claim 1, wherein the three-dimensional items are selected from the group consisting of a fashion doll, an animal, and an action figure.

3. The item storage, display and play system of claim 1, wherein the series of strategically placed item retention devices permanently incorporated into the multidimensional artwork in the scene further comprise a strap, wherein the strap removeably retains a fifth three-dimensional item of the three-dimensional items such that a first portion of the fifth three-dimensional item is visible on the first side of the multidimensional artwork and a second portion of the fifth three-dimensional item is obscured from view by the strap.

4. The item storage, display and play system of claim 1, wherein the series of strategically placed item retention devices permanently incorporated into the multidimensional artwork in the scene further comprise a loop, wherein the loop removeably retains a fifth three-dimensional item of the three-dimensional items such that a first portion of the fifth three-dimensional item is visible on the first side of the multidimensional artwork and a second portion of the fifth three-dimensional item is obscured from view by the loop.

5. The item storage, display and play system of claim 1, wherein the series of strategically placed item retention devices permanently incorporated into the multidimensional artwork in the scene further comprise a pocket, wherein the pocket removeably retains a fifth three-dimensional item of the three-dimensional items such that a first portion of the fifth three-dimensional item is visible on the first side of the multidimensional artwork and a second portion of the fifth three-dimensional item is obscured from view by the pocket.

6. The item storage, display and play system of claim 1, wherein the series of strategically placed item retention devices permanently incorporated into the multidimensional artwork in the scene further comprise a strap and a loop, wherein the strap removeably retains a fifth three-dimensional item of the three-dimensional items such that a first portion of the fifth three-dimensional item is visible on the first side of the multidimensional artwork and a second portion of the fifth three-dimensional item is obscured from view by the strap, wherein the loop removeably retains a sixth three-dimensional item of the three-dimensional items such that a first portion of the sixth three-dimensional item is visible on the first side of the multidimensional artwork and a second portion of the sixth three-dimensional item is obscured from view by the loop.

7. An item storage, display, and play system for unmodified three-dimensional items to be posed and placed on the system, the item storage, display, and play system comprising:

a durable, flexible, non-stretch textile configured removably retains the unmodified three-dimensional items, the textile comprising a vertical wall hanging decorative artwork, depicting a scene and activities in the scene, and being scaled to allow for integration of a variety of sizes and types of the unmodified three-dimensional items;

a device for hanging the textile; and a plurality of item retention devices for storage and display of the unmodified three-dimensional items on the textile, the plurality of item retention devices comprising a series of strategically placed item retention devices, plurality of item retention devices comprising cooperative slits including a first slit and an adjacent second slit, a flap and a cooperative third slit, a singular standalone fourth slit, and one or more selected from the group consisting of a fold down platform, a strap, and a loop, the cooperative slits removably retains a first three-dimensional item of the unmodified three-dimensional items such that a first portion of the first three-dimensional item is visible on a first side of the artwork and a second portion of the first three-dimensional item is obscured from view on a second side of the artwork, the flap and the cooperative third slit removably retains a second three-dimensional item of the unmodified three-dimensional items such that a first portion of the second three-dimensional item is visible on the first side of the artwork and a second portion of the second three-dimensional item is obscured from view on the second side of the artwork, the singular standalone fourth slit removably retains a third three-dimensional item of the unmodified three-dimensional items such that a first portion of the third three-dimensional item is visible on the first side of the artwork and a second portion of the third three-dimensional item is obscured from view on the second side of the artwork, and the fold down platform removably retains a fourth three-dimensional item of the unmodified three-dimensional items, the fold down platform at least partially hangs from a material strip;

wherein the unmodified three-dimensional items are placed by a user interacting with the depicted scene or activities depicted in the scene on the vertical wall hanging decorative artwork while being retained without the use of additional fastening devices; and wherein the vertical wall hanging decorative artwork configured for retention of one or more unmodified three-dimensional items functions as a complete decorative artwork with or in the absence of the one or more unmodified three-dimensional items.

8. The item storage, display and play system of claim 7, wherein the three-dimensional items are selected from the group consisting of a fashion doll, an animal, and an action figure.

9. The item storage, display and play system of claim 7, wherein the one or more item retention devices selected from the group consisting of a fold down platform, a strap, and a loop includes the strap, and wherein the strap removably retains a fifth three-dimensional item of the unmodified three-dimensional items such that a first portion of the fifth three-dimensional item is visible on the first side of the artwork and a second portion of the fifth three-dimensional item is obscured from view by the strap.

10. The item storage, display and play system of claim 7, wherein the one or more item retention devices selected from the group consisting of a fold down platform, a strap, and a loop includes the loop, and wherein the loop removably retains a fifth three-dimensional item of the unmodified three-dimensional items such that a first portion of the fifth three-dimensional item is visible on the first side of the artwork and a second portion of the fifth three-dimensional item is obscured from view by the loop.

11. The item storage, display and play system of claim 7, wherein the plurality of item retention devices further comprise a pocket, wherein the pocket removably retains a fifth three-dimensional item of the unmodified three-dimensional items such that a first portion of the fifth three-dimensional item is visible on the first side of the artwork and a second portion of the fifth three-dimensional item is obscured from view by the pocket.

* * * * *